US010020618B2

(12) United States Patent
Miyoshi

(10) Patent No.: US 10,020,618 B2
(45) Date of Patent: Jul. 10, 2018

(54) SHIELD CASE AND CONNECTOR PROVIDED WITH SAME

(71) Applicant: HOSIDEN CORPORATION, Yao-shi, Osaka (JP)

(72) Inventor: Toshiharu Miyoshi, Yao (JP)

(73) Assignee: Hosiden Corporation, Yao-Shi, Osaka (JP)

( * ) Notice: Subject to any disclaimer, the term of this patent is extended or adjusted under 35 U.S.C. 154(b) by 0 days.

(21) Appl. No.: 15/573,175

(22) PCT Filed: May 18, 2016

(86) PCT No.: PCT/JP2016/064683
§ 371 (c)(1),
(2) Date: Nov. 10, 2017

(87) PCT Pub. No.: WO2016/186120
PCT Pub. Date: Nov. 24, 2016

(65) Prior Publication Data

US 2018/0069350 A1 Mar. 8, 2018

(30) Foreign Application Priority Data

May 19, 2015 (JP) ..... 2015-102167

(51) Int. Cl.
*H01R 9/03* (2006.01)
*H01R 13/6589* (2011.01)
(Continued)

(52) U.S. Cl.
CPC ..... *H01R 13/6589* (2013.01); *H01R 13/502* (2013.01); *H01R 2105/00* (2013.01)

(58) Field of Classification Search
CPC ... H01R 13/6589; H01R 13/502; H01R 13/00
(Continued)

(56) References Cited

U.S. PATENT DOCUMENTS 3,149,897 A * 9/1964 Marlineck ..... H01R 17/00 439/660
5,389,006 A * 2/1995 Noschese ..... H01R 13/627 439/354
(Continued)

FOREIGN PATENT DOCUMENTS

JP H10241791 A 9/1998
JP 2001189181 A 7/2001
(Continued)

OTHER PUBLICATIONS

International Search Report (Form PCT/ISA/210) for International Patent Application No. PCT/JP2016/064683, issued from the Japan Patent Office, dated Jul. 26, 2016, 6 pages.
(Continued)

*Primary Examiner* — Jean F Duverne
(74) *Attorney, Agent, or Firm* — Kilyk & Bowersox, P.L.L.C.

(57) ABSTRACT

A first shell 400 includes a first and a second base 410*a*, 420*a* arranged side-by-side, a center plate 430*a*, a first and a second inner plate 440*a*, 450*a*, and a first and a second holding plate 460*a*, 470*a*. The center plate 430*a* is arranged on the Z-direction side relative to the first and second bases 410*a*, 420*a*. The first inner plate 440*a* extends from a first end 411*a* of the first base 410*a* to a first end 431*a* of the center plate 430*a*. The second inner plate 450*a* extends from a first end 421*a* of the second base 420*a* to a second end 432*a* of the center plate 430*a*. The first holding plate 460*a* is integral and contiguous with a second end 412*a* of the first base 410*a*. The second holding plate 470*a* is integral and contiguous with a second end 422*a* of the second base 420*a*.

21 Claims, 15 Drawing Sheets

(51) Int. Cl.
*H01R 13/502* (2006.01)
*H01R 105/00* (2006.01)

(58) Field of Classification Search
USPC ..... 439/607.15
See application file for complete search history.

(56) References Cited

U.S. PATENT DOCUMENTS

| | | | | |
|---|---|---|---|---|
| 6,004,160 | A * | 12/1999 | Korsunsky | H01R 17/00 439/660 |
| 6,323,430 | B1 | 11/2001 | Finona | |
| 6,489,563 | B1 | 12/2002 | Zhao et al. | |
| 6,547,605 | B2 * | 4/2003 | Daugherty | H01R 13/00 439/686 |
| 2006/0035523 | A1 | 2/2006 | Kuroda et al. | |
| 2011/0306228 | A1 | 12/2011 | Wu | |

FOREIGN PATENT DOCUMENTS

| | | | |
|---|---|---|---|
| JP | 2004071384 | A | 3/2004 |
| JP | 2004079377 | A | 3/2004 |
| JP | 2006054101 | A | 2/2006 |
| JP | 2006294572 | A | 10/2006 |
| WO | 2013006592 | A2 | 1/2013 |

OTHER PUBLICATIONS

Extended European Search Report for European Application No. EP 16796513.6 published by the European Patent Office (EPO), dated Feb. 16, 2018, including corresponding Communication, Annex, Information on Search Strategy, and 5-page EPO Form 1703.

* cited by examiner

SHIELD CASE AND CONNECTOR PROVIDED WITH SAME

BACKGROUND OF THE INVENTION

Technical Field

The present invention relates to a shield case and a connector having the same.

Background Art

Patent Literature 1 identified below discloses a conventional first connector. The first connector includes a housing, a shell, terminals, and a plurality of cables. The shell is held by the housing and holds the cables at spaced intervals along a first direction. The first direction is the longitudinal direction of the shell. The shell includes a base and a plurality of holding portions. The base is a rectangular plate extending in the first direction. The holding portions each include a trunk and a holding portion body. The trunks are plates extending in a second direction from an end in the second direction of the base and being arranged at spaced intervals along the first direction. The second direction is the short direction of the shell. The holding portion bodies are plates being provided at distal ends of the trunks and extending in the first direction. The holding portion bodies are curved such as to be wound around the peripheries of the cables. The terminals are held by the housing and connected to the core wires of the cables.

The shell of the first connector is formed by press-forming a single metal plate. In this case, adjacent ones of the holding portions, in planar development state, need be disposed at predetermined intervals along the first direction. This necessity results in increased dimension of the shell in the first direction.

Patent Literature 2 identified below discloses a conventional second connector, which may solve the above problem of the first connector. The second connector has a shell including a base and a plurality of holding portions. The base is a rectangular plate extending in a first direction. The first direction is the longitudinal direction of the shell of the second connector. The holding portions each include a trunk, a first holding piece, and a second holding piece. The trunks are plates extending in a second direction from an end in the second direction of the base and are arranged at spaced intervals along the first direction of the base. The second direction is the short direction of the shell of the second connector. The trunks each include a front portion and a rear portion in the second direction. The first holding pieces extend from the rear portions of the trunks to the one side of the first direction. The second holding pieces extend from the front portions of the trunk to the other side in the first direction. In adjacent ones of holding portions in planar development state, the first holding piece of one of the holding portions and the second holding portion of the other holding portion partially coincide each other in the second direction. Accordingly, the space between the adjacent holding portions is decreased, decreasing the dimension of the shell in the first direction.

CITATION LIST

Patent Literatures

Patent Literature 1: JP 2006-294572 A
Patent Literature 2: JP 2006-54101 A

SUMMARY OF INVENTION

Technical Problem

However, there is a limit in the decrease of the space in the first direction between the holding portions of the second connector. This is because adjacent holding portions in planar development state must be arranged with a large enough space between the first holding piece of one of the adjacent holding portions and the trunk of the other holding portion so as to allow separation therebetween.

The invention is conceived in view of the above problems, and the invention provides a shield case with a reduced dimension in a first direction in three-dimensional state and with a larger space in the first direction between adjacent holding plates in planar development state. The invention also provides a connector having such shield case.

Solution to Problem

A shield case of an aspect of the invention includes a first shell constituted by a metal plate. The first shell includes a first base of a plate-like shape, a second base of a plate-like shape, a center plate, a first inner plate, a second inner plate, a first holding plate, and a second holding plate. The first base and the second base are arranged in spaced side-by-side relation along a first direction. The first base comprises a first end at a side of the second base and a second end at one side of a second direction. The second direction crosses the first direction. The second base includes a first end at a side of the first base and a second end at one side of the second direction. The center plate is arranged on one side of a third direction relative to the first and second bases, and the center plate includes a first end on the one side of the first direction and a second end on the other side of the first direction. The third direction crosses the first and second directions. The first inner plate extends to the one side of the third direction, from the first end of the first base to the first end of the center plate. The second inner plate extends to the one side of the third direction, from the first end of the second base to the second end of the center plate. The first holding plate is integral and contiguous with the second end of the first base. The second holding plate is integral and contiguous with the second end of the second base.

The shield case of this aspect has the following technical features. Firstly, the first shell of the shield case in three-dimensional state a decreased dimension in the first direction for the following reasons. The first shell of the shield case in the three-dimensional state is configured such that: the center plate is arranged on the one side of the third direction relative to the first base and the second base; the first inner plate extends to the one side of the third direction, from the first end of the first base to the first end of the center plate; and the second inner plate extends to the one side of the third direction, from the first end of the second base to the second end of the center plate. In this configuration, the space in the first direction between the first base and the second base is narrow, thereby decreasing the dimension in the first direction of the first shell in the three-dimensional state. Secondly, the first shell of the shield case in planar development state has an increased space in the first direction between the first holding plate and the second holding plate. The first shell in planar development state is configured such that the center plate, the first inner plate, the second inner plate, the first base, and the second base are aligned along the first direction. Such alignment results in that the space in the first direction between the first base and the second base increases by the sum of the dimensions in the first direction of the center plate, the first inner plate and the second inner plate. This in turn results in that the space in the first direction substantially increases between the first holding plate, which is integral and contiguous with the first base, and the second holding plate, which is integral and contiguous with the second base. Therefore, it is easy to form the first holding plate and the second holding plate when pressing a single metal plate to form the first shell.

The first shell may further include a first outer plate and a second outer plate. The first outer plate may be formed at the first base and located on the one side of the first direction relative to the first inner plate with a space therebetween. The second outer plate may be formed at the second base and located on the other side of the first direction relative to the second inner plate with a space therebetween. The shield case of this aspect is provided with a first housing space and a second housing space. The first housing space is defined by the first base, the first inner plate, and the first outer plate. The second housing space is defined by the second base, the second inner plate, and the second outer plate.

The shield case of any of the above aspects may further include a block portion having electrical conductivity. The block portion may be arranged in abutment with or in spaced relation to the center plate of the first shell. The block portion may include a first facing portion and a second facing portion. The first facing portion may be arranged in facing relation to and in spaced relation in the third direction to the first base. The second facing portion may be arranged in facing relation to and in spaced relation in the third direction to the second base. The shield case of this aspect is provided with a first housing space and a second housing space. The first housing space is defined by the first base, the first inner plate, and the first facing portion. The second housing space is defined by the second base, the second inner plate, and the first facing portion.

The first shell may further include a first engaging portion. The first engaging portion may be provided at at least one of the first inner plate, the second inner plate, and the center plate. The block portion may further include a second engaging portion. One of the first engaging portion and the second engaging portion may include an engaging protrusion, and the other may include an engaging hole to engage with the engaging protrusion. In the shield case of this aspect, it is easy to engage the block portion with the first shell.

The first shell may further include a third engaging portion. The third engaging portion may be formed on at least one of the first outer plate and the second outer plate. The block portion may further include a fourth engaging portion. The fourth engaging portion may be formed on at least one of the first facing portion and the second facing portion. One of the third engaging portion and the fourth engaging portion may include an engaging protrusion and the other may include an engaging hole to engage with the engaging protrusion. In the shield case of this aspect, it is easy to engage the block portion with the first shell.

The shield case of any of the above aspects may further include a second shell having electrical conductivity. The second shell may include a shell body.

The first shell of any of the above aspects may further include a fifth engaging portion provided at at least one of the first base and the second base. The second shell may further include a sixth engaging portion provided at the shell body. One of the fifth engaging portion and the sixth engaging portion comprises an engaging protrusion, and the other comprises an engaging hole to engage with the engaging protrusion. In the shield case of this aspect, it is easy to engage the second shell with the first shell.

The shield case of any of the above aspects may further include a third shell having electrical conductivity. The third shell may include a first plate and a third holding plate. The first plate of the third shell may be arranged between the first base and the second base or between the first inner plate and the second inner plate. The first plate may include an end on one side of the second direction. The third holding plate of the third shell may be provided at the end of the first plate of the third shell and arranged between the first holding plate and the second holding plate. In the shield case of this aspect, the existence of the third shell does not result in increase in dimension in the first direction of the shield case in three-dimensional state for the following reason. The first plate of the third shell is arranged between the first base and the second base or between the first inner plate and the second inner plate, and the third holding plate of the third shell is arranged between the first holding plate and the second holding plate.

The third shell may further include a shell body between the first inner plate and the second inner plate. The shell body of the third shell may include the first plate of the third shell, a second plate and a third plate. The first plate of the shell body may interjoin the second plate and the third plate.

The second plate of the shell body of the third shell may be in abutment with the first inner plate. The third plate of the shell body may be in abutment with the second inner plate. The shield case of this aspect has improved strength. This is because the second plate of the shell body of the third shell abuts the first inner plate, and the third plate of the shell body of the third shell abuts the second inner plate.

The shell body of the third shell may further include a fourth plate. The fourth plate of the third shell may interjoin the second plate and the third plate.

The fourth plate of the third shell may be in abutment with the center plate of the first shell. The shield case of this aspect has further improved strength. This is because the fourth plate of the shell body of the third shell abuts the center plate of the first shell.

The second shell of any of the above aspects may further include a seventh engaging portion provided at the shell body of the second shell. The third shell of any of the above aspects may include an eighth engaging portion. One of the seventh engaging portion and the eighth engaging portion may include an engaging protrusion, and the other may include an engaging hole to engage with the engaging protrusion. In the shield case of this aspect, it is easy to engage the third shell with the second shell.

A connector of a first aspect of the invention may include a first terminal, a second terminal, the shield case of any of the above aspects, a first cable, and a second cable. The first cable may be electrically connected to the first terminal and held by the first holding plate of the first shell. The second cable may be electrically connected to the second terminal and held by the second holding plate of the first shell.

The connector of the first aspect may further include a first body. The first body may hold the first terminal and the second terminal. The connector of this aspect has a decreased number of components. This is because the first terminal and the second terminal are held by a single first body. Alternatively, the connector of the first aspect may further include a first body and a second body. In this case, the first body may hold the first terminal and the second body may hold the second terminal.

The second shell of any of the above aspects may have electrical conductivity and house at least the first body.

Alternatively, the second shell of any of the above aspects may have electrical conductivity and house the first body and the second body.

The second shell may be omitted. In this case, preferable configurations are as follows. If the first body holds the first terminal and the second terminal, the first body may include a first holding portion, a second holding portion, and a joint portion. The first holding portion may be arranged on the first base of the first shell to hold the first terminal. The second holding portion may be arranged on the second base of the first shell to hold the second terminal. The joint portion may interjoin the first holding portion and the second holding portion. If the first body holds the first terminal and the second body holds the second terminal, the first body may be arranged on the first base of the first shell, and the second body may be arranged on the second base of the first shell.

The connector of any of the above aspects may further include a third terminal and a third cable. The third cable may be electrically connected to the third terminal and held by the third holding plate of the third shell of any of the above aspects.

The connector of any of the above aspects may further include a third body to hold the third terminal. The joint portion of the first body may include a housing portion. The third body may be housed in the housing portion. If the first body is housed in the second shell, the third body may also be housed in the second shell. The connector of this aspect has a decreased number of components. This is because the first terminal and the second terminal are held by a single first body, and the first body and the third body are housed in a single second shell. Alternatively, if the first holding portion of the first body is arranged on the first base of the first shell and the second holding portion of the first body is arranged on the second base of the first shell, the third body may be arranged on the first plate of the third shell of any of the above aspects.

The second shell of any of the above aspects may include the block portion of any of the above aspects. Also, the shell body of the second shell of any of the above aspects may be arranged on the other side or the one side of the second direction relative to the first shell. The shell body of the second shell may house the first body, may house the first body and the second body, or may house the first body and the third body.

The shield case of any of the above aspects may further include a first cover and a second cover. The first cover may be provided at the block portion to cover the first cable partially. The second cover may be provided at the block portion to cover the second cable partially. The first holding plate may hold the first cover and the first cable. The second holding plate may hold the second cover and the second cable.

The shield case of any of the above aspects may further include a third cover. The third cover may be provided at the block portion of any of the above aspects to cover the third cable partially. Alternatively, the third cover may not be provided at the block portion but at the fourth plate of the third shell of any of the above aspects. In either case, the third holding plate of the third shell of any of the above aspects may hold the third cover and the third cable.

DESCRIPTION OF EMBODIMENTS

A connector C according to embodiments of the invention will be hereinafter described with reference to FIGS. 1A to 6B. The connector C includes a first unit C1 (see FIGS. 3A and 3B), and a second unit C2 (see FIGS. 4A and 4B). Components of the connector C will be hereinafter described in detail. Here, the X-X' direction shown in FIGS. 2A, 2B, 2E to 2H, and 3A to 4B is the short direction of the connector C and corresponds to the first direction in the claims. In the X-X' direction, the X direction corresponds to one side of the first direction, and the X' direction corresponds to the other side of the first direction. The Y-Y' direction shown in FIGS. 2C to 4B is the longitudinal direction of the connector C and corresponds to the second direction in the claims. The Y-Y' direction is orthogonal to the X-X' direction. In the Y-Y' direction, the Y' direction corresponds to one side of the second direction, and the Y direction corresponds to the other side of the second direction. The Z-Z' direction shown in FIGS. 2A, 2B, 2E to 2H, and 3A to 4B is the height direction of the connector C and corresponds to the third direction in the claims. In the Z-Z' direction, the Z direction corresponds to one side of the third direction, and the Z' direction corresponds to the other side of the third direction. The Z-Z" direction is orthogonal to the X-X' and Y-Y' directions.

The first unit C1 includes a body 100*a* (first body), at least one first terminal 200*a*, at least one second terminal 200*b*, a first cable 300*a*, a second cable 300*b*, a first shell 400*a*, and a second shell 400*b*. The second unit C2 includes a body 100*b* (third body), at least one third terminal 200*c*, a third cable 300*c*, and a third shell 400*c*. It should be appreciated that the first shell 400*a*, the second shell 400*b*, and the third shell 400*c* constitute a shield case S of the connector C.

Also, a plurality of the first terminals 200*a*, a plurality of the second terminals 200*b*, and a plurality of the third terminals 200*c* may be provided.

Figure 1A:
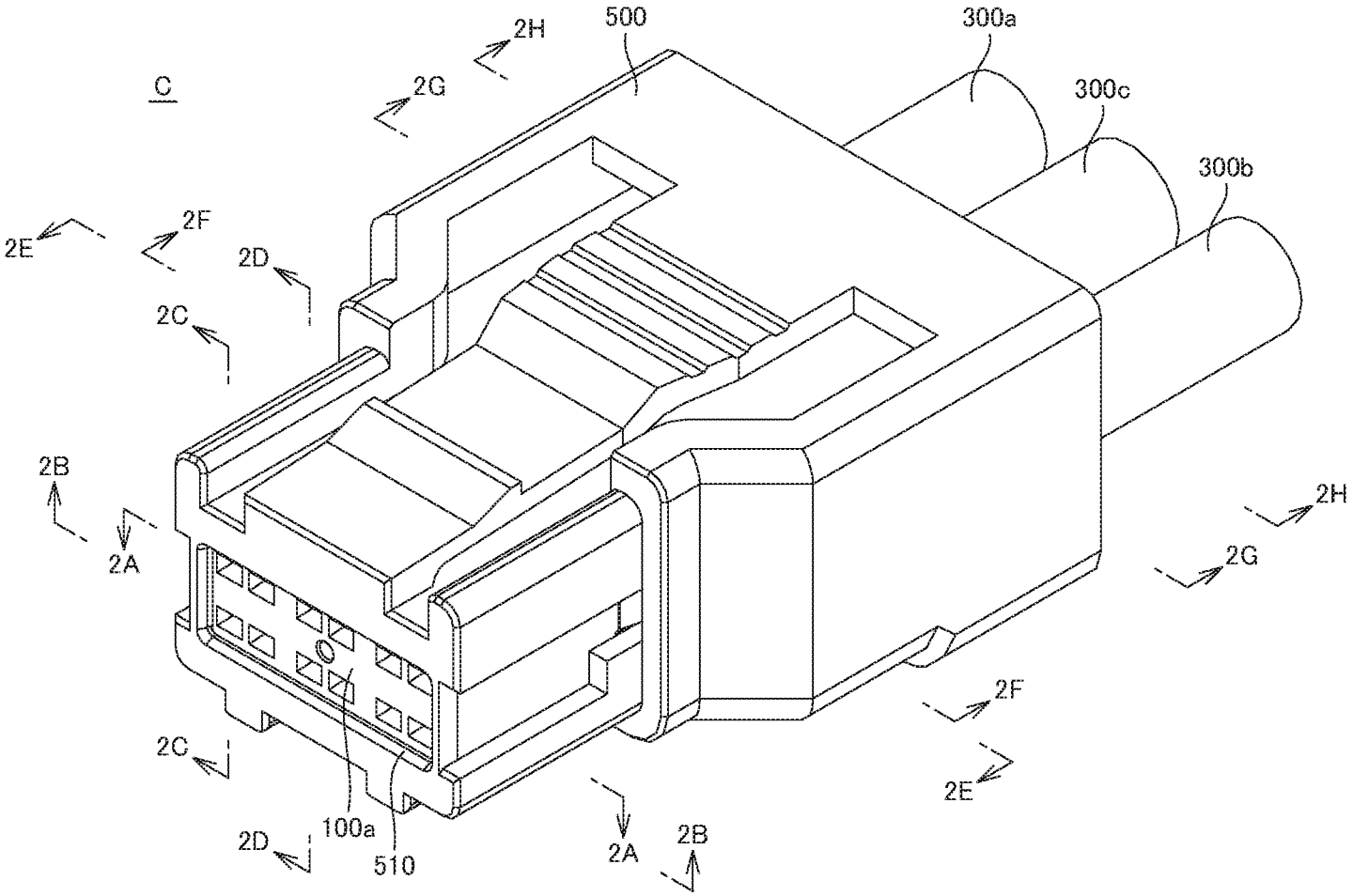
FIG. 1A is a front, top, right side perspective view of a connector of an aspect according to embodiments of the invention.
Figure 1B:
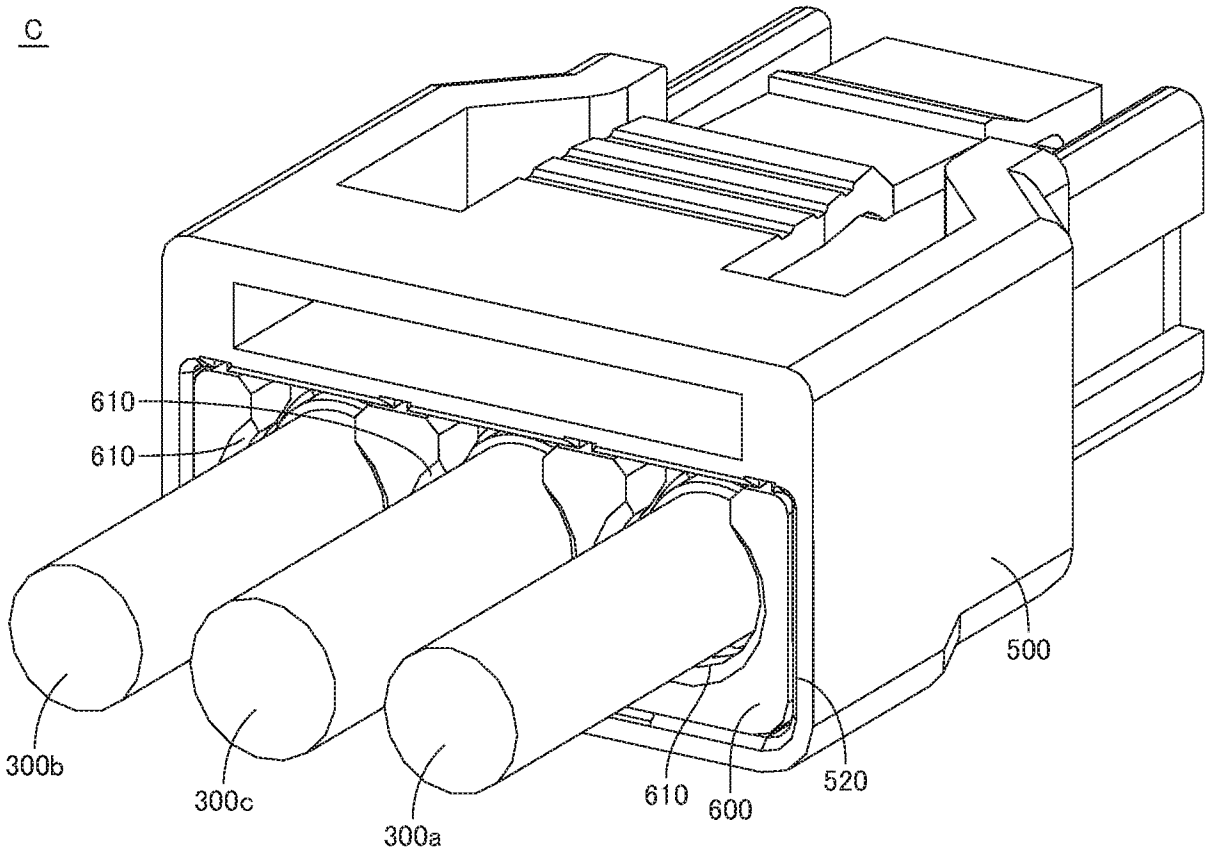
FIG. 1B is a rear, top, left side perspective view of the connector.
Figure 2A:
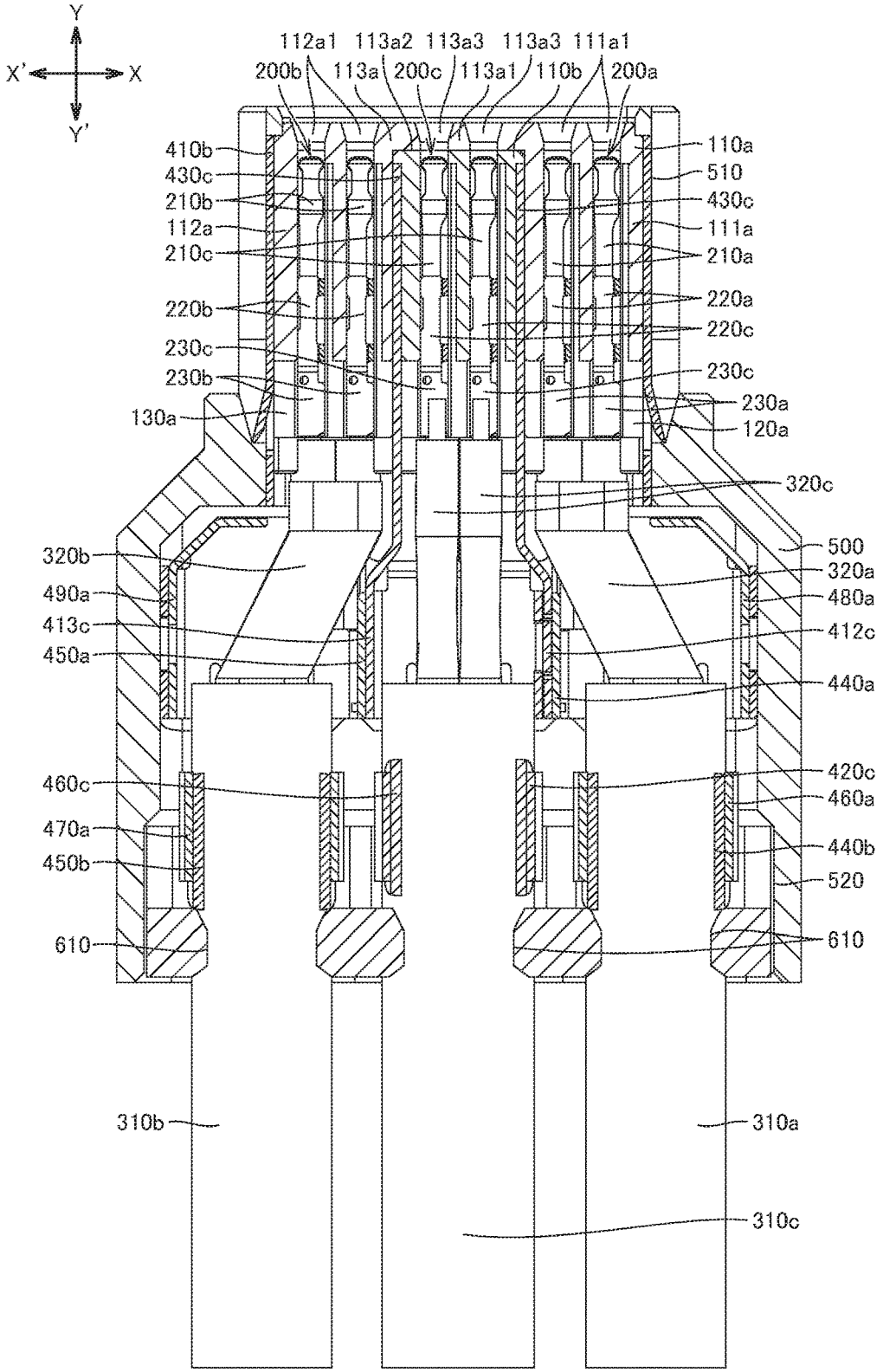
FIG. 2A is a cross-sectional view of the connector taken along line 2A-2A in FIG. 1A.
Figure 2B:
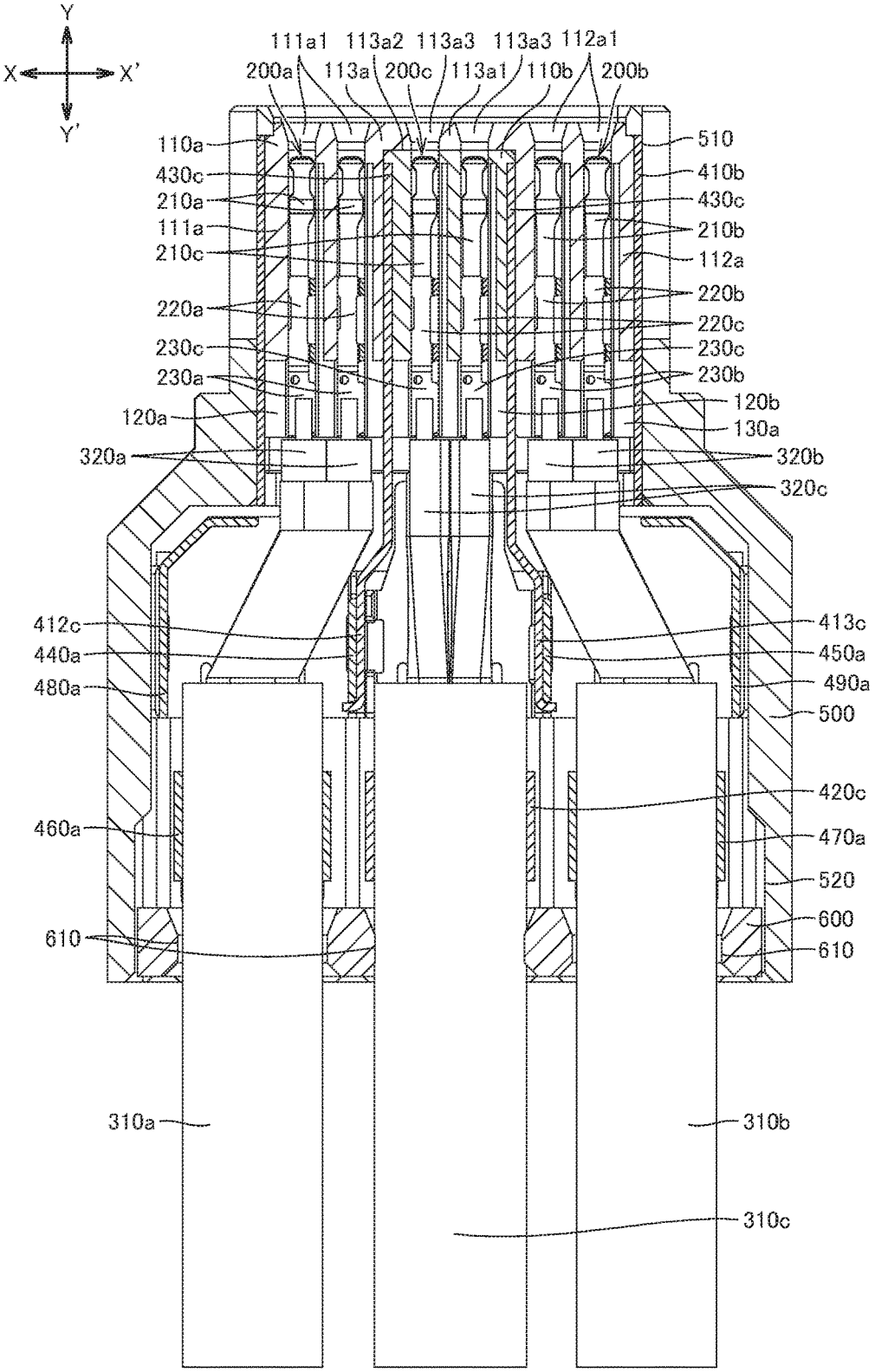
FIG. 2B is a cross-sectional view of the connector taken along line 2B-2B in FIG. 1A.
Figure 2C:
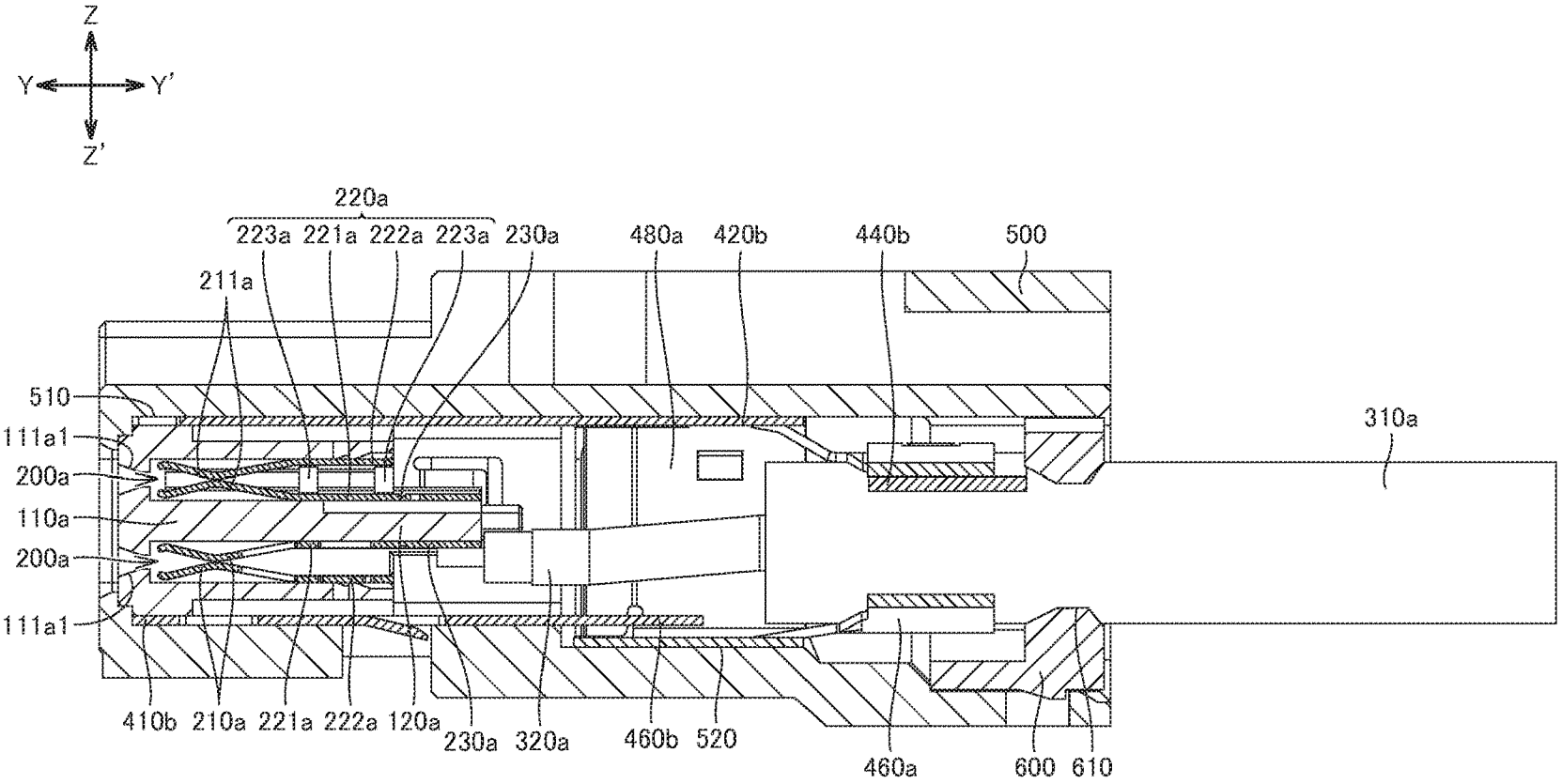
FIG. 2C is a cross-sectional view of the connector taken along line 2C-2C in FIG. 1A.
Figure 2D:
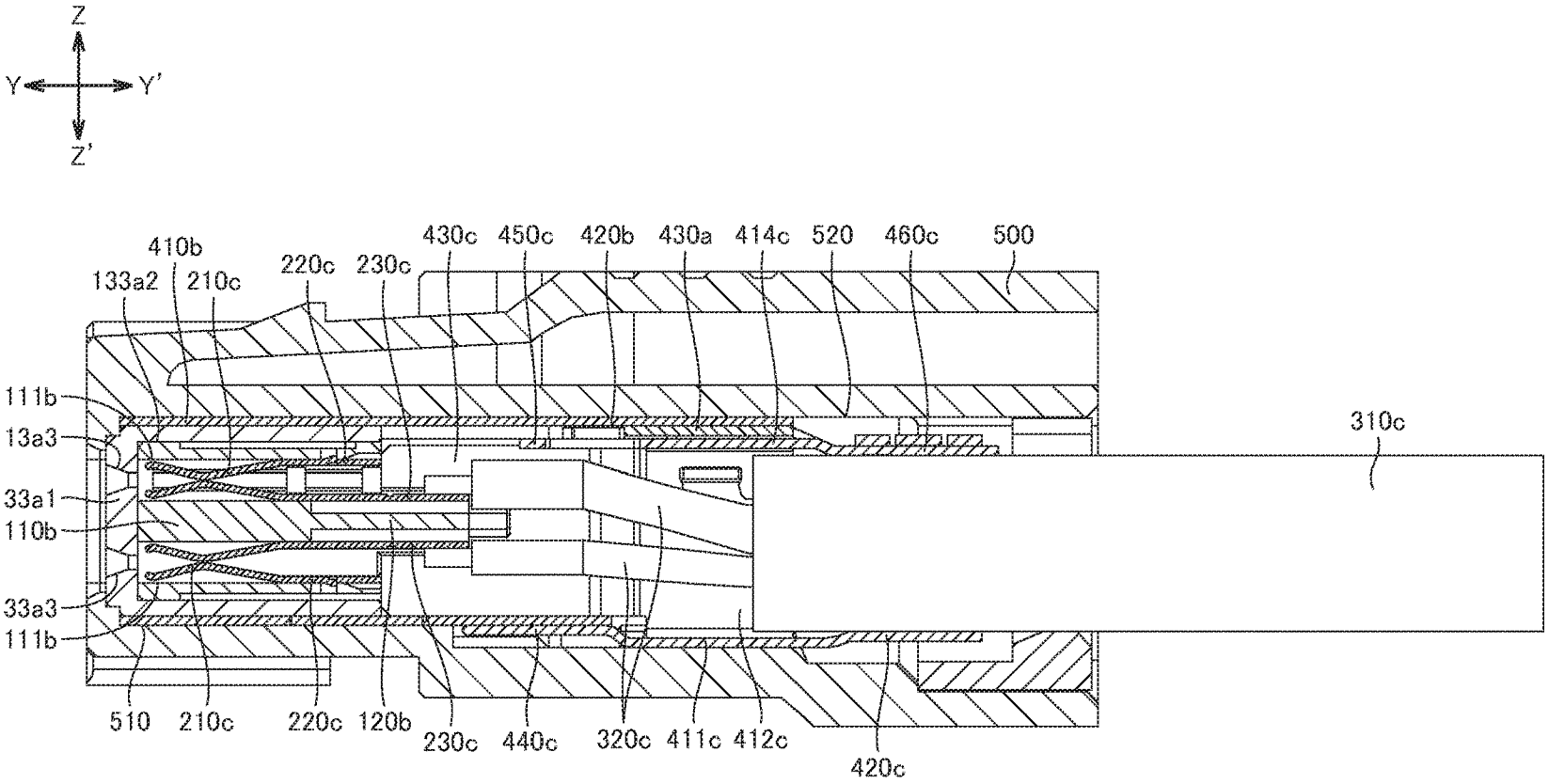
FIG. 2D is a cross-sectional view of the connector taken along line 2D-2D in FIG. 1A.
Figure 2E:
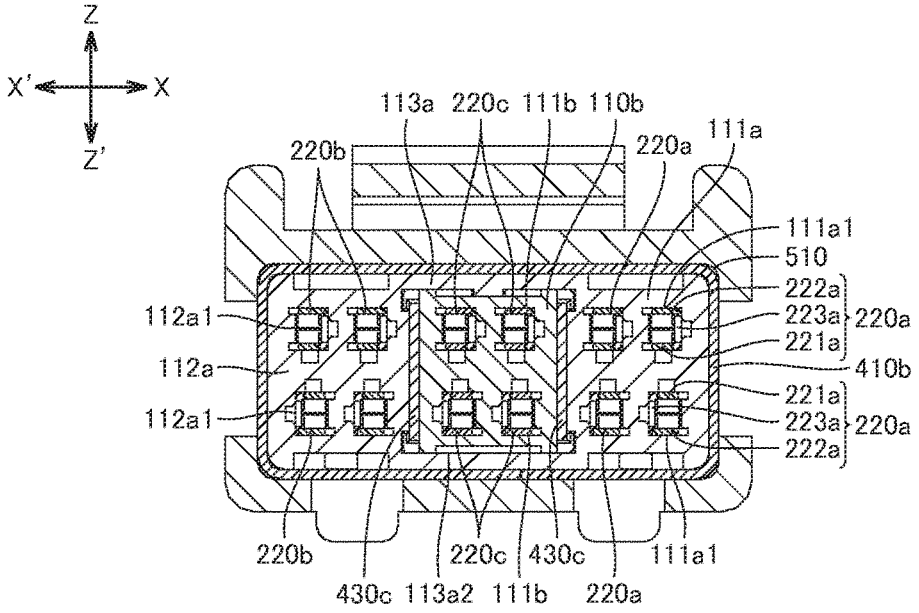
FIG. 2E is a cross-sectional view of the connector taken along line 2E-2E in FIG. 1A.

The first and second terminals 200*a* and 200*b* are each constituted by a metal plate. The first and second terminals 200*a* and 200*b* are held by the body 100*a*. Each first terminal 200*a* includes a contact portion 210*a*, an intermediate portion 220*a*, and a tail 230*a*. The intermediate portion 220*a* may only interjoin the contact portion 210*a* and the tail portion 230*a* and be adapted to be held by the body 100*a*. For example, as best illustrated in FIGS. 2C and 2E, the intermediate portion 220*a* includes a first plate 221*a*, a second plate 222*a*, and at least one joint plate 223*a*. The first plate 221*a* and the second plate 222*a* extend in the Y-Y' direction and face each other in the Z-Z' direction. The joint plate 223*a* interjoins the first plate 221*a* and the second plate 222*a*.

Each contact portion 210*a* may only be contactable with a corresponding terminal of a mating connector. For example, the contact portion 210*a* may include a pair of arms 211*a* facing each other in Z-Z' direction. One of the arms 211*a* extends from the first plate 221*a* in the Y direction and the other arm 211*a* extends from the second plate 222*a* in the Y direction. Distal end portions of the arms 211*a* are bent such as to approach each other. The tail 230*a* may only extend from the intermediate portion 220*a* in the Y' direction. For example, the tail 230*a* may extend from the first plate 221*a* of the intermediate portion 220*a* in the Y' direction.

The second terminal 220*b* will not be described because it has a similar configuration to that of the first terminal 200*a*. Each second terminal 200*b* includes a contact portion 210*b*, an intermediate portion 220*b*, and a tail 230*b*.

Figure 4A:
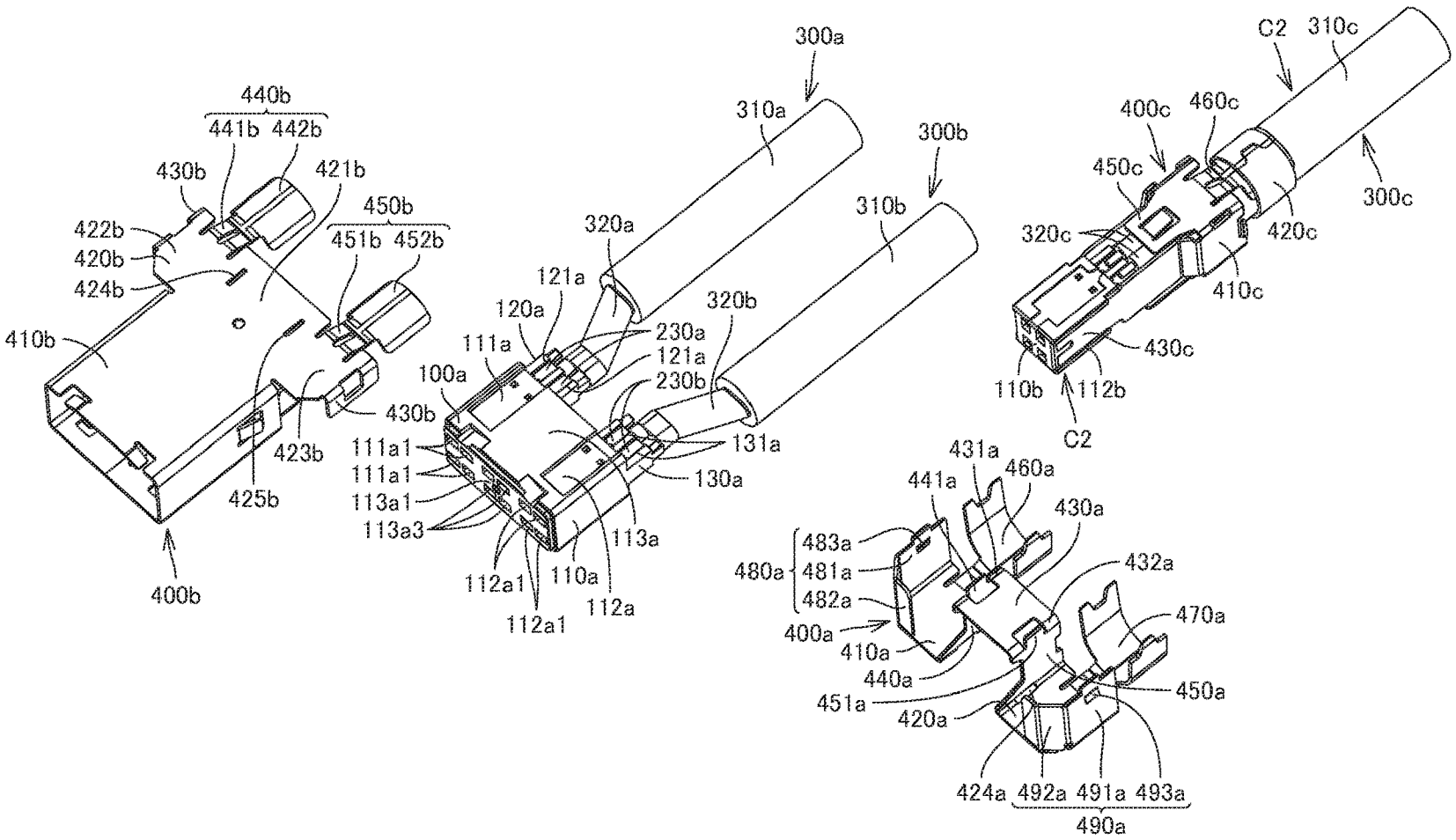
FIG. 4A is a front, top, right side exploded perspective view of the first unit and the second unit of the connector.
Figure 4B:
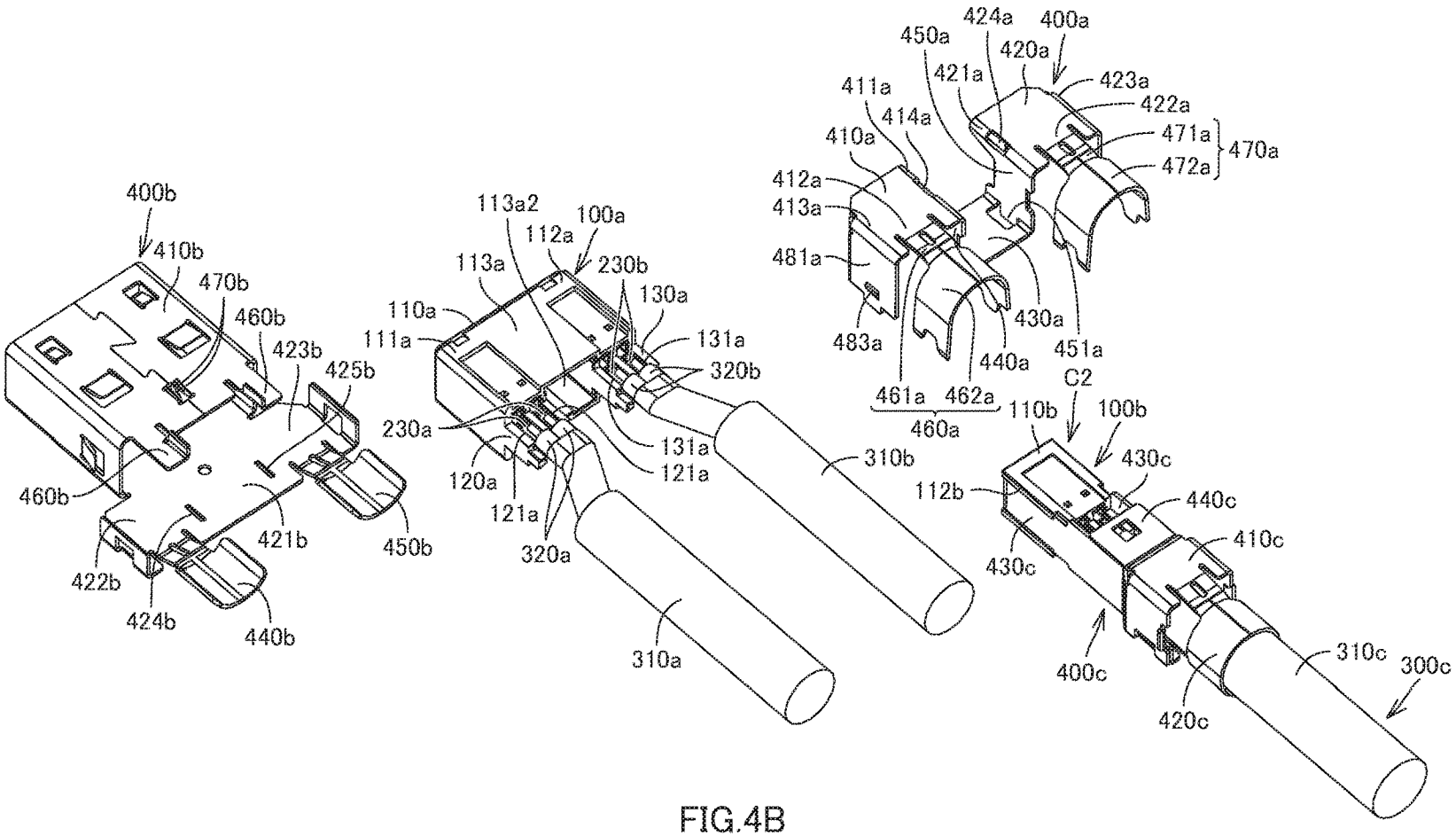
FIG. 4B is a rear, bottom, left side exploded perspective view of the first unit and the second unit of the connector.

The body 100*a*, best illustrated in FIG. 4A and FIG. 4B, is constituted by insulation resin. The body 100*a* includes a main body 110*a*. The main body 110*a* is a rectangular block. The main body 110*a* includes a first holding portion 111*a*, a second holding portion 112*a*, and a joint portion 113*a*.

The first holding portion 111*a* holds the at least one first terminal 200*a* of the main body 110*a*. For example, as best illustrated in FIG. 4A and FIG. 4B, the first holding portion 111*a* may be an X-direction-side end portion of the main body 110*a*. The first holding portion 111*a* may be provided with at least one holding hole 111*a*1 to hold the first terminal 200*a*. For example, the first holding portion 111*a* may be provided with a plurality of holding holes 111*a*1 arranged in two rows in the Z-Z' direction, at spaced intervals along X-X' direction. As best illustrated in FIG. 2C, each holding hole 111*a*1 extends through the first holding portion 111*a* in the Y-Y' direction. Each holding hole 111*a*1 has a shape conforming to the outer shapes of the intermediate portion 220*a* and the contact portion 210*a* of the corresponding first terminal 200*a*. Each holding hole 111*a*1 holds the intermediate portion 220*a* of a first terminal 200*a* and houses the contact portion 210*a* of the first terminal 200*a*. Alternatively, the at least one first terminal 200*a* may be insert-molded in the first holding portion 111*a*. In this case, the holding hole 111*a*1 is omitted.

The second holding portion 112*a* holds the at least one second terminal 200*b* of the main body 110*a*. For example, as best illustrated in FIG. 4A and FIG. 4B, the second holding portion 112*a* may be an X'-direction side end portion of the main body 110*a*. The second holding portion 112*a* may be provided with at least one holding hole 112*a*1 to hold the second terminal 200*b*. For example, the second holding portion 112*a* may be provided with a plurality of holding holes 112*a*1 arranged in two rows in the Z-Z' direction, at spaced intervals along X-X' direction. Each holding hole 112*a*1 has a similar configuration to that of the holding hole 111*a*1 and extends through the second holding portion 112*a* in the Y-Y' direction (see FIG. 2C showing a similar configuration). Each holding hole 112*a*1 holds the intermediate portion 220*b* of a second terminal 200*b* and houses the contact portion 210*b* of the second terminal 200*b*. Alternatively, the at least one second terminal 200*b* may be insert-molded in the second holding portion 112*a*. In this case, the holding hole 112*a*1 is omitted.

The joint portion 113*a* may only interjoin the first holding portion 111*a* and the second holding portion 112*a*. For example, the joint portion 113*a* may be a part of the main body 110*a* located between the first holding portion 111*a* and the second holding portion 112*a*. The joint portion 113*a* may include a front panel 113*a*1 and a housing portion 113*a*2. The housing portion 113*a*2 is a rectangular hole in the joint portion 113*a* and extends in the Y-Y" direction. The housing portion 113*a*2 is open to the Y'-direction side. The front panel 113*a*1 is disposed such as to block the Y-direction side of the housing portion 113*a*2. The front panel 113*a*1 is provided with at least one opening 113*a*3. Each opening 113*a*3 communicates with a housing portion 113*a*2. For example, the front panel 113*a*1 is provided with a plurality of openings 113*a*3 arranged in two rows in the Z-Z' direction, at spaced intervals along the X-X' direction. Also, each housing portion 113*a*2 may be a space between the first holding portion 111*a* and the second holding portion 112*a* joined by the joint portion 113*a*.

Figure 2F:
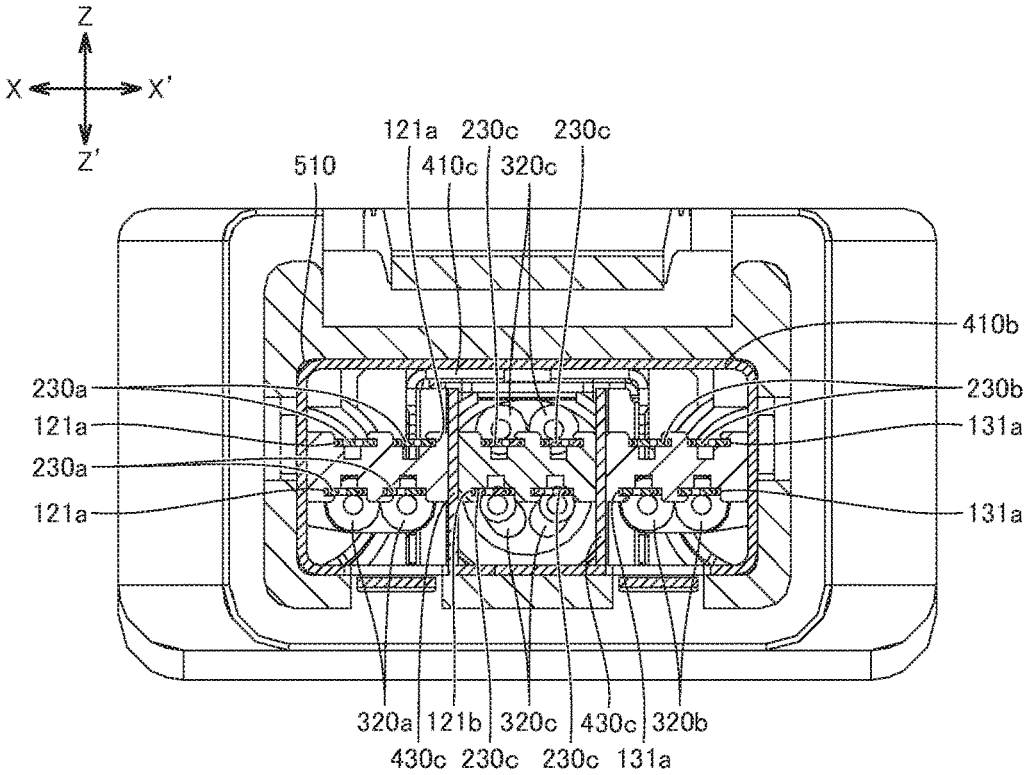
FIG. 2F is a cross-sectional view of the connector taken along line 2F-2F in FIG. 1A.

As best illustrated in FIG. 4A and FIG. 4B, the body 100*a* may further include a first table 120*a* and a second table 130*a*. The first table 120*a* extends in the Y' direction from the Y'-direction-side end face of the first holding portion 111*a*. The first table 120*a* may only be able to support the tail 230*a* of the at least one first terminal 200*a*. The first table 120*a* may include at least one holding groove 121*a*. Each holding groove 121*a* is provided in the first table 120*a* such as to communicate with a holding hole 111*a*1 of the first holding portion 111*a*. Each holding groove 121*a* houses and supports a tail 230*a*. For example, as best illustrated in FIG. 2F, a plurality of holding grooves 121*a* may be provided in the Z-direction-side face of the first table 120*a*, at spaced intervals along the X-X' direction, and another plurality of holding grooves 121*a* may be provided in the Z'-direction-side face of the first table 120*a*, at spaced intervals along the X-X' direction.

The second table 130*a* extends in the Y' direction from the Y'-direction-side end face of the second holding portion 112*a*. The second table 130*a* may only be able to support the tail 230*b* of the at least one second terminal 200*b*. The second table 130*a* may include at least one holding groove 131*a*. Each holding groove 131*a* is provided in the second table 130*a* such as to communicate with a holding hole 112*a*1 of the second holding portion 112*a*. The holding groove 131*a* houses and supports the tail 230*b*. For example, as best illustrated in FIG. 2F, a plurality of holding grooves 131*a* may provided in the Z-direction-side surface of the second table 130*a*, at spaced intervals along the X-X' direction, and another plurality of holding grooves 131*a* may be provided in the Z'-direction-side surface of the second table 130*a*, at spaced intervals along the X-X' direction.

Figure 5:
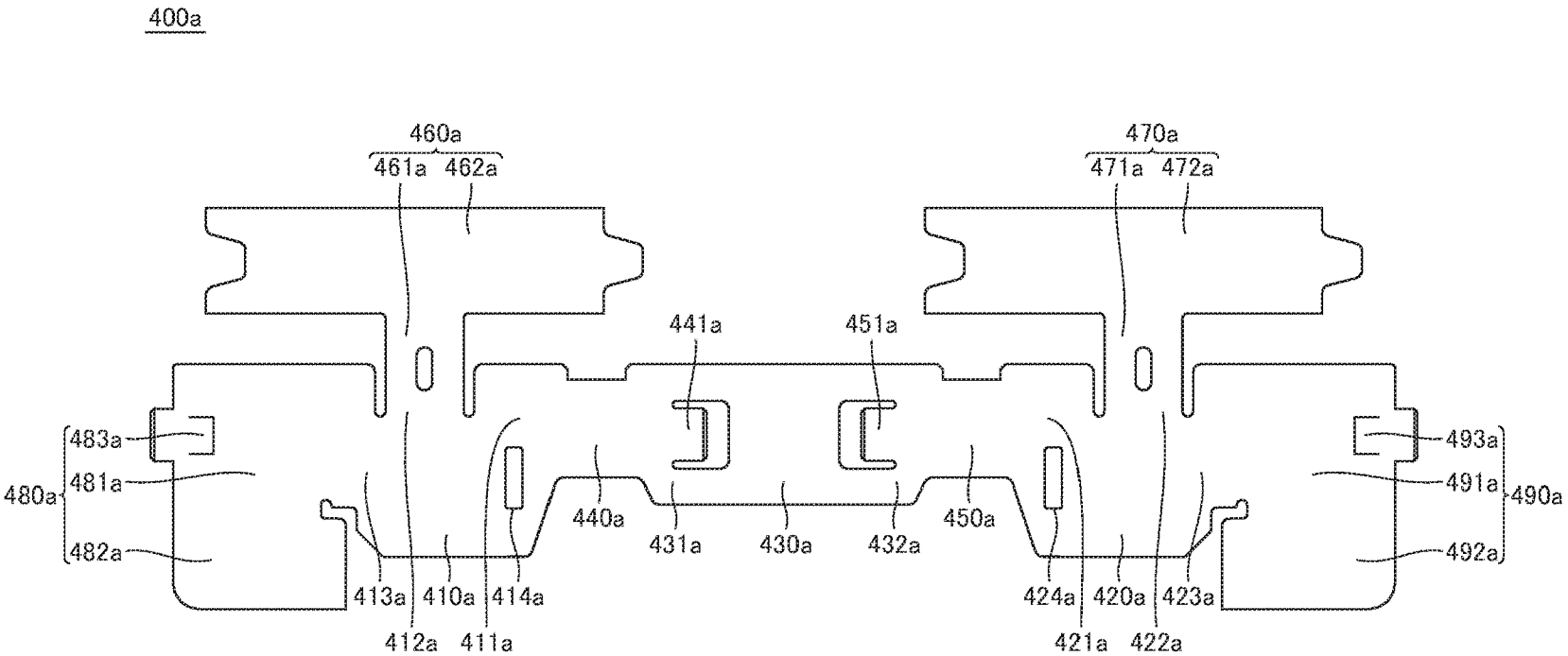
FIG. 5 is a developed view of a first shell of the first unit of the connector.

The first shell 400*a* is arranged on the Y'-direction side relative to the body 100*a*. The first shell 400*a* is formed by press-forming a single metal plate. A three-dimensional state of the first shell 400*a* is best illustrated in FIGS. 4A and 4B, and a planar development state of the first shell 400*a* is best illustrated in FIG. 5. The first shell 400*a* includes a first base 410*a*, a second base 420*a*, a center plate 430*a*, a first inner plate 440*a*, a second inner plate 450*a*, a first holding plate 460*a*, and a second holding plate 470*a*. The center plate 430*a* is a central part of the metal plate mentioned above (a part of the metal plate). The center plate 430*a* extends in the X-X' and Y-Y' directions. The center plate 430*a* is arranged on the Z-direction side relative to the first base 410*a* and the second base 420*a*. For example, the center plate 430*a* may be arranged on the Z-direction side relative to, and between, the first base 410*a* and the second base 420*a*. The center plate 430*a* includes a first end 431*a* and a second end 432*a*. The first end 431*a* is the X-direction-side end of the center plate 430*a*. The second end 432*a* is the X'-direction-side end of the center plate 430*a*.

The first base 410*a* is a part of the metal plate on the X-direction side relative to the center plate 430*a* (i.e. the first base 410*a* has a plate-like shape). The first base 410*a* extends in the X-X' and Y-Y' directions. The second base 420*a* is a part of the metal plate on the X'-direction side relative to the center plate 430*a* (i.e. the second base 420*a* has a plate-like shape). The second base 420*a* extends in the X-X' and Y-Y' directions. The first base 410*a* and the second base 420*a* are arranged side-by-side along the X-X' direction. The first base 410*a* and the second base 420*a* may be arranged at the same height position, or at different height positions, in the Z-Z' direction.

The first base 410*a* includes a first end 411*a*, a second end 412*a*, and a third end 413*a*. The first end 411*a* is the X'-direction-side end of the first base 410*a* (the end at the side of the second base 420*a*). The second end 412*a* is the Y'-direction-side end of the first base 410*a*. The second end 412*a* may have a central part recessed in the Y direction or may be flat. The third end 413*a* is the X-direction-side end of the first base 410*a*. The second base 420*a* includes a first end 421*a*, a second end 422*a*, and a third end 423*a*. The first end 421*a* is the X-direction-side end of the second base 420*a* (the end at the side of the first base 410*a*). The second end 422*a* is the Y'-direction-side end of the second base 420*a*. The second end 422*a* may have a central part recessed in the Y direction or may be flat. The third end 423*a* is the X'-direction-side end of the second base 420*a*.

The first inner plate 440*a* is a part between the center plate 430*a* and the first base 410*a* of the metal plate. The first inner plate 440*a* extends in the Z direction, from the first end 411*a* of the first base 410*a* to the first end 431*a* of the center plate 430*a*. The first inner plate 440*a* may be inclined in the X direction, the X' direction, the Y direction, the Y' direction, a direction including X- and Y-direction components, a direction including a X'- and Y-direction components, a direction including a X- and a Y'-direction components, or a direction including a X'- and a Y'-direction components. Off course, the first inner plate 440*a* may not be inclined, i.e. may extend at an angle of about 90 degrees to the first base 410*a*.

The second inner plate 450*a* is a part between the center plate 430*a* and the second base 420*a* of the metal plate. The second inner plate 450*a* extends in the Z direction, from the first end 421*a* of the second base 420*a* to the second end 432*a* of the center plate 430*a*. The second inner plate 450*a* may be inclined in the X direction, the X' direction, the Y direction, the Y' direction, a direction including X- and Y-direction components, a direction including a X'- and Y-direction components, a direction including a X- and a Y'-direction components, or a direction including a X'- and a Y'-direction components. Off course, the second inner plate 450*a* may not be inclined, i.e. may extend at an angle of about 90 degrees to the second base 420*a*.

The first holding plate 460*a* is a part at the Y'-direction side of the first base 410*a* of the metal plate. The first holding plate 460*a* is integral and contiguous with the second end 412*a* of the first base 410*a*. The first holding plate 460*a* includes a trunk 461*a* and a holding plate body 462*a*. The trunk 461*a* is a plate extending in the Y' direction from the second end 412*a* of the first base 410*a*. The holding plate body 462*a* is a plate integral and contiguous with the Y'-direction-side end of the trunk 461*a*. In planar development state, the holding plate body 462*a* is larger in X-X' direction dimension than the trunk 461*a*.

The second holding plate 470*a* is a part at the Y'-direction side of the second base 420*a* of the metal plate. The second holding plate 470*a* is integral and contiguous with the second end 422*a* of the second base 420*a*. The second holding plate 470*a* includes a trunk 471*a* and a holding plate body 472*a*. The trunk 471*a* is a plate extending in the Y' direction from the second end 422*a* of the second base 420*a*. The holding plate body 472*a* is a plate integral and contiguous with the Y'-direction-side end of the trunk 471*a*. In planar development state, the holding plate body 472*a* is larger in X-X' direction dimension than the trunk 471*a*.

The first shell 400*a* may further include a first outer plate 480*a* and a second outer plate 490*a*. The first outer plate 480*a* may only be provided at the first base 410*a* such as to be on the X-direction side relative to the first inner plate 450*a* with a space therebetween. For example, the first outer plate 480*a* may be a part on the X-direction side of the first base 410*a* of the metal plate and extend in the Z direction from the third end 413*a* of the first base 410*a*. The first outer plate 480*a* may be a piece formed by cutting and raising a part of the first base 410*a*, or may be a member separately formed from the first base 410*a* to be fixed to the first base 410*a*. The first outer plate 480*a* may be inclined in the X direction, the X' direction, the Y direction, the Y' direction, a direction including X- and Y-direction components, a direction including a X'- and Y-direction components, a direction including a X- and a Y'-direction components, or a direction including a X'- and a Y'-direction components. Off course, the first outer plate 480*a* may not be inclined, i.e. may extend at an angle of about 90 degrees to the first base 410*a*. The first outer plate 480*a*, the first base 410*a*, and the first inner plate 440*a* may define a first housing space.

The first outer plate 480*a* may include an outer plate body 481*a* and an extension plate 482*a*. The outer plate body 481*a* extends in the Z direction from the third end 413*a* of the first base 410*a*. The outer plate body 481*a* includes a Y-direction-side end.

The extension plate 482*a* is integral and contiguous with the Y-direction-side end of the outer plate body 481*a*. The extension plate 482*a* is bent to the X'-direction side relative to the outer plate body 481*a* so as to partially cover the Y-direction side of the first housing space. A first gap is left between the extension plate 482*a* and the first inner plate 440*a*.

The second outer plate 490*a* may only be provided at the second base 420*a* such as to be on the X-direction side relative to the second inner plate 460*a* with a space therebetween. For example, the second outer plate 490*a* may be a part on the X'-direction side of the second base 420*a* of the metal plate and extend in the Z direction from the third end 423*a* of the second base 420*a*. The second outer plate 490*a* may be a piece formed by cutting and raising a part of the second base 420*a*, or may be a member separately formed from the second base 420*a* to be fixed to the second base

420*a*. The second outer plate 490*a* may be inclined in the X direction, the X' direction, the Y direction, the Y' direction, a direction including X- and Y-direction components, a direction including a X'- and Y-direction components, a direction including a X- and a Y'-direction components, or a direction including a X'- and a Y'-direction components. Off course, the second outer plate 490*a* may not be inclined, i.e. may extend at an angle of about 90 degrees to the second base 420*a*. The second outer plate 490*a*, the second base 420*a*, and the second inner plate 450*a* may define a second housing space.

The second outer plate 490*a* may include an outer plate body 491*a* and an extension plate 492*a*. The outer plate body 491*a* extends in the Z direction from the third end 423*a* of the second base 420*a*. The outer plate body 491*a* includes a Y-direction-side end.

The extension plate 492*a* is integral and contiguous with the Y-direction-side end of the outer plate body 491*a*. The extension plate 492*a* is bent to the X-direction side relative to the outer plate body 491*a* so as to partially cover the Y-direction side of the second housing space. A second gap is left between the extension plate 492*a* and the second inner plate 450*a*.

The first cable 300*a* includes an outer insulator 310*a*, a shield conductor (not shown), and at least one transmission wire 320*a*. The outer insulator 310*a* is a tuboid sheath. The shield conductor, tuboid braided conductive wires or a helically wound metal foil tape, is arranged inside the outer insulator 310*a*. The transmission wire(s) 320*a* is arranged inside the shield conductor. The Y-direction-side end portion of the outer insulator 310*a* is cut off such as to expose the Y-direction-side end portion end portion of the shield conductor. Around the exposed shield conductor is wound the holding plate body 462*a* of the first holding plate 460*a* for electrically connection therebetween (see FIGS. 2A to 2C, 2H, 3A, and 3B). The Y-direction-side end portion of the transmission wire 320*a* protrudes in the Y direction from the shield conductor. The protruding portion of each transmission wire 320*a* (hereinafter referred to as the protruding portion) is cut off at its distal end such as to expose the core wire inside the transmission wire 320*a*. The protruding portion of each transmission wire 320*a* passes through the first housing space and the first gap, and the core wire of each transmission wire 320*a* is electrically connected to the tail 230*a* of a first terminal 200*a*. For example, there may be two transmission wires 320*a*, the core wires of which may be connected to the respective tails 230*a* of two first terminals 200*a* on the Z' direction side. It should be noted that FIGS. 2A to 2C, 2G, and 2H show only the outline of the section of the first cable 300*a*. FIGS. 4A and 4B show the holding plate body 462*a* before being wound around the shield conductor.

The second cable 300*b* has a similar configuration to that of the first cable 300*a*. The second cable 300*b* includes an outer insulator 310*b*, a shield conductor (not shown), and at least one transmission wire 320*b*. The holding plate body 472*a* of the second holding plate 470*a* is wound around and electrically connected to the exposed portion of the shield conductor (see FIGS. 2A, 2B, 2H, 3A, and 3B). The protruding portion of each transmission wire 320*b* passes through the second housing space and the second gap, and the core wire of each transmission wire 320*b* is electrically connected to the tail 230*b* of a second terminal 200*b*. For example, there may be two transmission wires 320*b*, the core wires of which may be connected to the tails 230*b* of two second terminals 200*b* on the Z' direction side. It should be noted that FIGS. 2A, 2B, 2G, and 2H show only the outline of the section of the second cable 300*b*. FIGS. 4A and 4B show the holding plate body 472*a* before being wound around the shield conductor.

As best illustrated in FIGS. 4A and 4B, the second shell 400*b* is formed by press-forming a single metal plate. The second shell 400*b* includes a shell body 410*b* and a block portion 420*b*. The shell body 410*b* is a tube extending in the Y-Y' direction and arranged on the Y-direction side relative to the first shell 400*a*. The shell body 410*b* has an inner shape conforming to the outer shape of the body 100*a*. The shell body 410*b* houses the body 100*a*. The shell body 410*b* includes a first plate on the Z'-direction side, a second plate on the X-direction side, a third plate on the X'-direction side and a fourth plate on the Z-direction side. The first plate includes an X-direction-side end and an X'-direction-side end. The fourth plate includes an X-direction-side end and an X'-direction-side end. The second plate integrally interjoins the X-direction-side end of the first plate and the X-direction-side end of the fourth plate. The third plate integrally interjoins the X'-direction-side end of the first plate and the X'-direction-side end of the fourth plate.

Figure 2G:
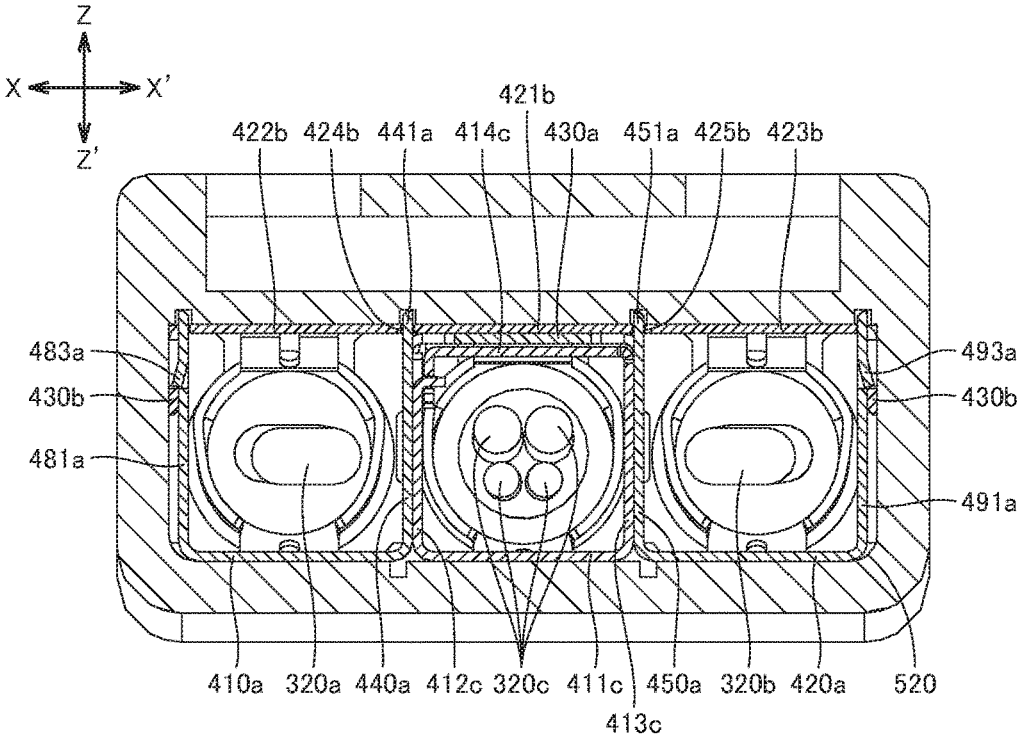
FIG. 2G is a cross-sectional view of the connector taken along line 2G-2G in FIG. 1A.

The block portion 420*b* is a plate extending in the Y' direction from the fourth plate of the shell body 410*b*. The block portion 420*b* is arranged in abutment with the center plate 430*a* of the first shell 400*a* from the Z-direction side or in spaced relation in the Z-Z' direction to the center plate 430*a*. The block portion 420*b* blocks the first housing space and the second housing space of the first shell 400*a* from the Z-direction side. The block portion 420*b* may include a center portion 421*b*, a first facing portion 422*b*, and a second facing portion 423*b*. As best illustrated in FIG. 2G, the center portion 421*b* is in abutment (in surface contact) with the center plate 430*a* from the Z-direction side. The first facing portion 422*b* is in facing relation to and in spaced relation in the Z-Z' direction to the first base 410*a* of the first shell 400*a* and blocks the first housing space from the Z-direction side. The first facing portion 422*b* may be in abutment with the first outer plate 480*a* of the first shell 400*a*. If the first outer plate 480*a* is omitted, the first housing space may preferably be defined by the first base 410*a*, the first inner plate 440*a*, and the first facing portion 422*b*. The second facing portion 423*b* is in facing relation to and in spaced relation in the Z-Z' direction to the second base 420*a* of the first shell 400*a* and blocks the second housing space from the Z-direction side. The second facing portion 423*b* may be in abutment with the second outer plate 490*a* of the first shell 400*a*. If the second outer plate 490*a* is omitted, the second housing space may preferably be defined by the second base 420*a*, the second inner plate 450*a*, and the second facing portion 423*b*. The first facing portion 422*b* includes an X-direction-side end and an Y'-direction-side end. The second facing portion 423*b* includes an X'-direction-side end and an Y'-direction-side end.

At least one of the first inner plate 440*a*, the second inner plate 450*a*, and the center plate 430*a* of the first shell 400*a* may be provided with a first engaging portion. The block portion 420*b* of the second shell 400*b* may be provided with a second engaging portion. One of the first engaging portion and the second engaging portion may include an engaging protrusion, and the other may have an engaging hole to engage with the engaging protrusion.

For example, as best illustrated in FIG. 2G and FIG. 4A, the first inner plate 440*a* may include a first engaging portion 441*a*, and the second inner plate 450*a* may include another first engaging portion 451*a*. The first engaging portion 441*a* includes an engaging protrusion of a plate-like shape, which is formed by cutting and bending a part of the center plate

430*a* such that the cut part extends in the Z direction from the first inner plate 440*a*. The first engaging portion 451*a* includes an engaging protrusion of a plate-like shape, which is formed by cutting and bending another part of the center plate 430*a* such that the cut part extends in the Z direction from the second inner plate 450*a*. In this case, the block portion 420*b* includes second engaging portions 424*b*, 425*b*. The second engaging portion 424*b* has an engaging hole at a position corresponding to the first engaging portion 441*a* of the block portion 420*b*. The second engaging portion 425*b* has an engaging hole at a position corresponding to the first engaging portion 451*a* of the block portion 420*b*. The first engaging portion 441*a* is engaged with the second engaging portion 424*b* from the Z'-direction side, and the first engaging portion 451*a* is engaged with the second engaging portion 425*b* from the Z'-direction side.

Further, if the center plate 430*a* includes at least one first engaging portion, the first engaging portion may include an engaging protrusion of a plate-like shape, which is formed by cutting and bending a part of at least one of the center plate 430*a*, the first inner plate 440*a*, and the second inner plate 450*a* such that the cut part extends in the Z direction from the center plate 430*a*. In this case, at least one second engaging portion may include an engaging hole to engage with the first engaging portion, at a position corresponding to the first engaging portion of the center plate 430*a* of the block portion 420*b*. Alternatively, the at least one second engaging portion may include an engaging protrusion of a plate-like shape, which is formed by cutting and bending a part of the block portion 420*b* such that the cut part extends in the Z' direction from the block portion 420*b*. In this case, the at least one first engaging portion may have an engaging hole to engage with the second engaging portion of the block portion 420*b*, in at least one of the first inner plate 440*a*, the second inner plate 450*a*, and the center plate 430*a*.

At least one of the first outer plate 480*a* and the second outer plate 490*a* of the first shell 400*a* may be provided with a third engaging portion. At least one of the first facing portion 422*b* and the second facing portion 423*b* of the block portion 420*b* of the second shell 400*b* may be provided with a fourth engaging portion. One of the third engaging portion and the fourth engaging portion may include may include an engaging protrusion, and the other may include an engaging hole to engage with the engaging protrusion.

For example, as best illustrated in FIG. 2G and FIG. 4A, the first outer plate 480*a* may include a third engaging portion 483*a*, and the second outer plate 490*a* may include a third engaging portion 493*a*. The third engaging portion 483*a* includes an engaging protrusion of a plate-like shape, which is formed by cutting a part of the outer plate body 481*a* and bending the cut part to the X direction. The third engaging portion 493*a* includes an engaging portion of a plate-like shape, which is formed by cutting a part of the outer plate body 491*a* and bending the cut part in the X' direction. In this case, the block portion 420*b* includes a pair of fourth engaging portions 430*b* (one and the other fourth engaging portions 430*b*). The one fourth engaging portion 430*b* includes an engaging piece, which extends in the Z' direction from the X-direction-side end of the first facing portion 422*b*, and an engaging hole formed in the engaging piece. The other fourth engaging portion 430*b* includes an engaging piece, which extends in the Z' direction from X'-direction-side end of the second facing portion 423*b*, and an engaging hole formed in the engaging piece. The third engaging portion 483*a* and the third engaging portion 493*a* are engaged with the respective engaging holes of the fourth engaging portions 430*b*.

The pair of fourth engaging portions may include engaging protrusions in place of the engaging holes. The engaging protrusion of each fourth engaging portion may be a plate formed by cutting and bending a part of an engaging piece. In this case, the third engaging portion of the first outer plate 480*a* may have an engaging hole to engage with the engaging protrusion of the one fourth engaging portion. The third engaging portion of the second outer plate 490*a* may have an engaging hole to engage with the engaging protrusion of the other fourth engaging portion.

At least one of the first base 410*a* and the second base 420*a* of the first shell 400*a* may be provided with a fifth engaging portion. The shell body 410*b* of the second shell 400*b* may be provided with a sixth engaging portion. One of the fifth engaging portion and the sixth engaging portion may include an engaging protrusion, and the other may include an engaging hole to engage with the engaging protrusion.

Figure 3A:
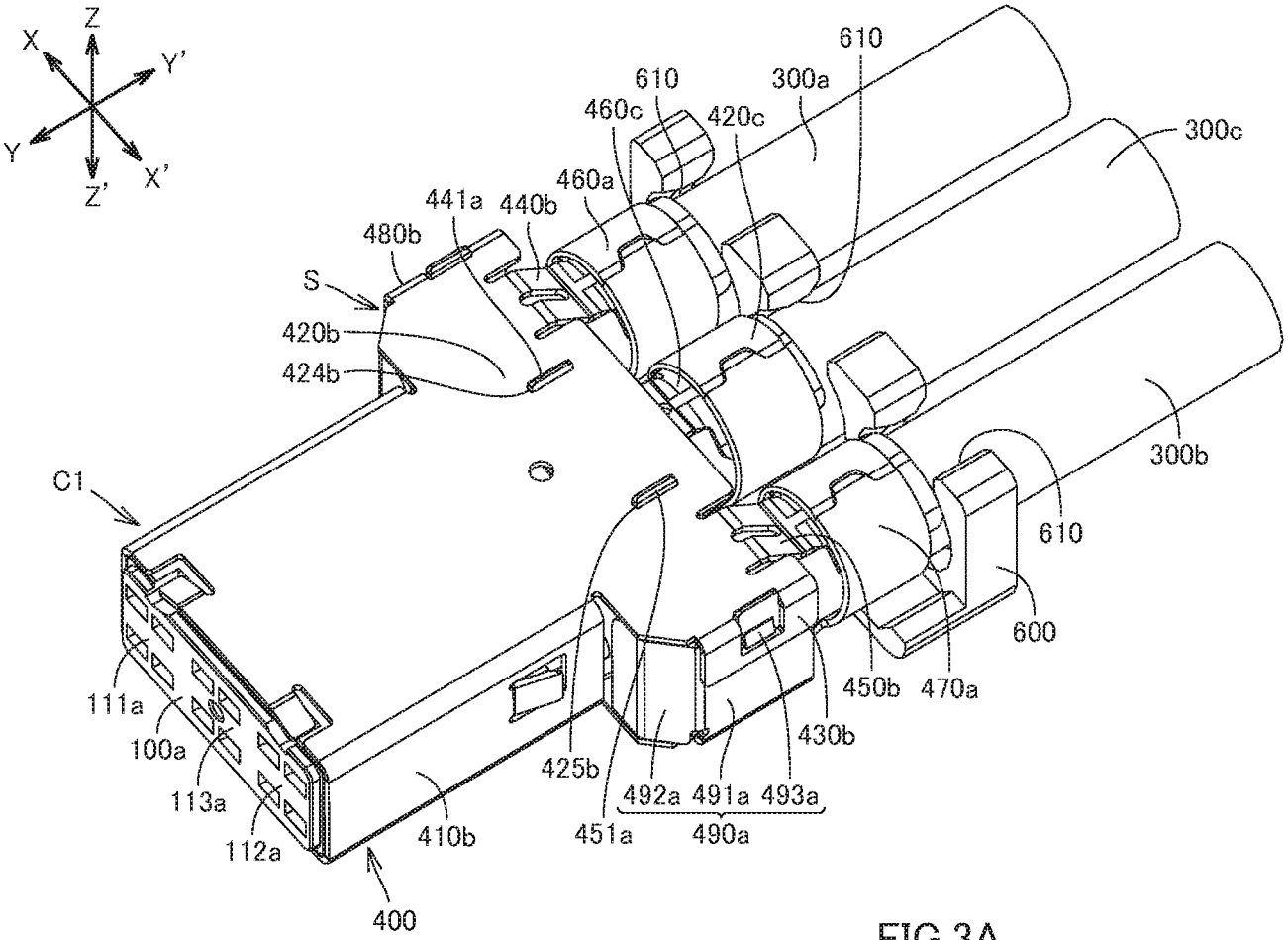
FIG. 3A is a front, top, right side perspective view of a first unit, a second unit, and a cap of the connector.
Figure 3B:
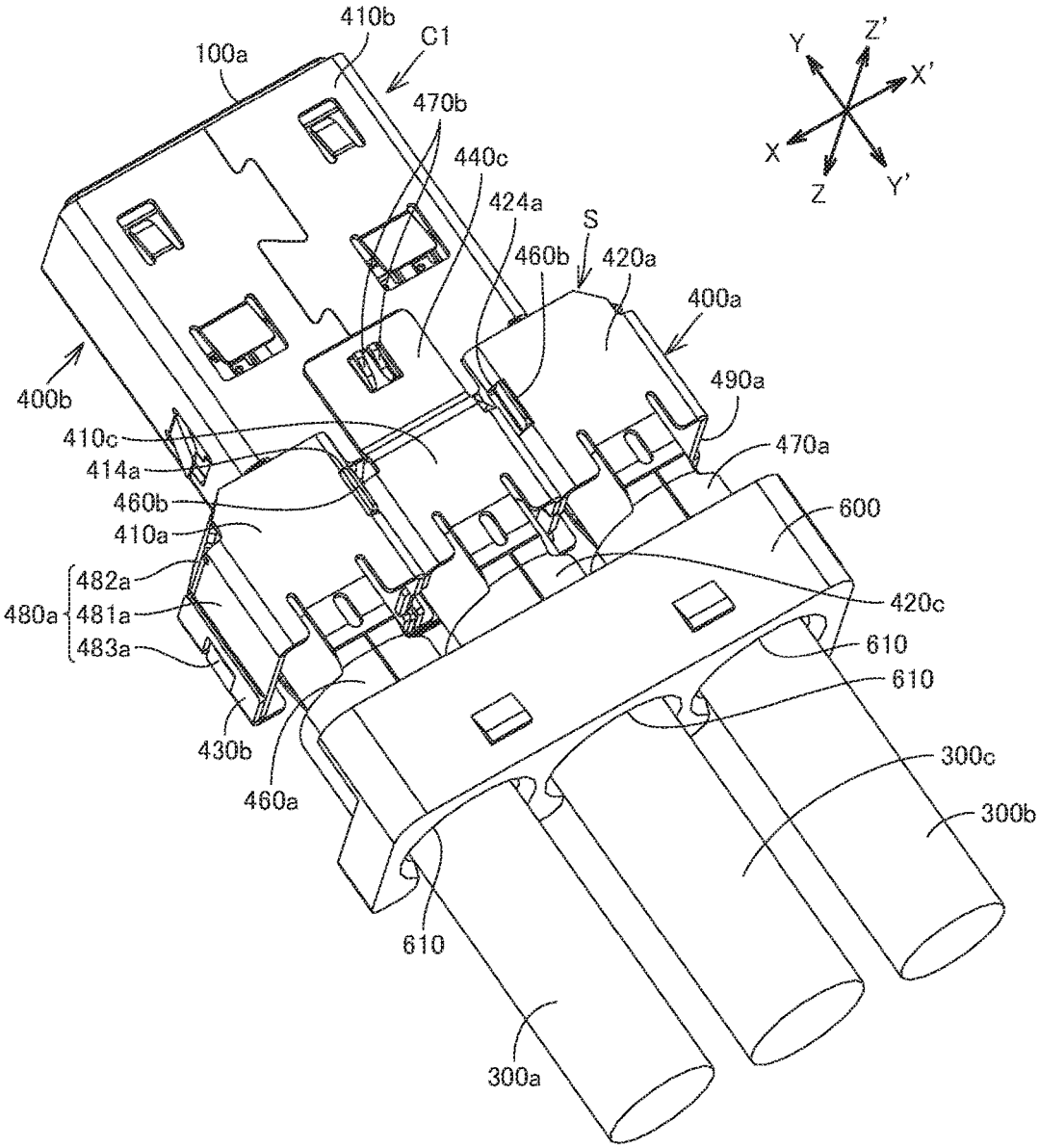
FIG. 3B is a rear, bottom, left side perspective view of the first unit, the second unit, and a cap of the connector.

For example, as best illustrated in FIG. 3B and FIG. 4B, the second shell 400*b* may include a pair of sixth engaging portions 460*b*. Each sixth engaging portion 460*b* includes an arm, which extends in the Y' direction from the first plate of the shell body 410*b*, and an engaging protrusion provided at the arm. In this case, the first shell 400*a* includes a fifth engaging portion 414*a* and a fifth engaging portion 424*a*. The fifth engaging portion 414*a* includes an engaging hole in the first base 410*a*. The fifth engaging portion 424*a* includes an engaging hole in the second base 420*a*. The engaging holes of the fifth engaging portion 414*a* and the fifth engaging portion 424*a* are engaged with the respective engaging protrusions of the sixth engaging portions 460*b*.

Further, the sixth engaging portion may include an engaging hole instead of the engaging protrusion. The engaging hole of each sixth engaging portion may be provided at the arm or at the first plate of the shell body 410*b*. In the latter case, the arm is omitted. In these cases, each fifth engaging portion may include engaging protrusions of a plate-like shape, which is formed by cutting and bending parts of the first base 410*a* and the second base 420*a*. The engaging protrusions of the fifth engaging portions are engaged with the respective engaging holes of the sixth engaging portions.

Figure 2H:
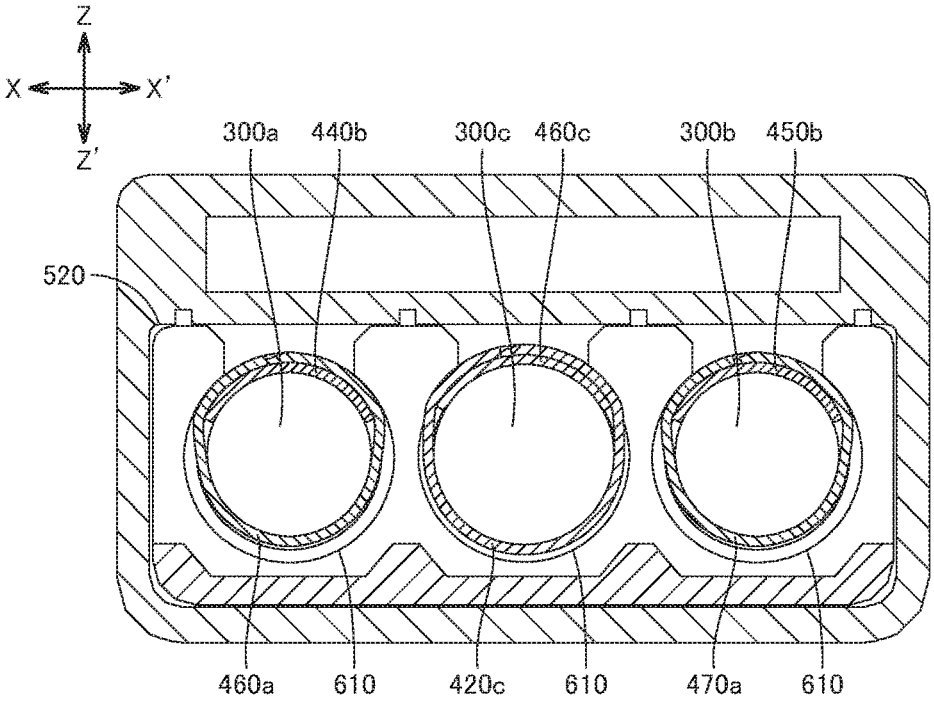
FIG. 2H is a cross-sectional view of the connector taken along line 2H-2H in FIG. 1A.

The second shell 400*b* may further include at least one of a first cover 440*b* and a second cover 450*b*. The first cover 440*b* is provided at the first facing portion 422*b* of the block portion 420*b* of the second shell 400*b*. The first cover 440*b* includes a base 441*b* and a cover body 442*b*. The base 441*b* is a plate extending in the Y' direction from the Y'-direction-side end of the first facing portion 422*b*. The cover body 442*b* is a plate of an arc shape that is integral and contiguous with the Y'-direction-side end of the base 441*b*. The cover body 442*b* partially covers the exposed shield conductor of the first cable 300*a*. If the second shell 400*b* includes the first cover 440*b*, the first holding plate 460*a* of the first shell 400*a* is curved so as to be wound around the cover body 442*b* and the exposed shield conductor of the first cable 300*a* as best illustrated in FIG. 2H.

The second cover 450*b* includes a base 451*b* and a cover body 452*b*. The base 451*b* is a plate extending in the Y' direction from the Y'-direction-side end of the second facing portion 423*b*. The cover body 452*b* is a plate of an arc shape integral and contiguous with the Y'-direction-side end of the base 451*b*. The cover body 452*b* partially covers the exposed shield conductor of the second cable 300*b*. If the second shell 400*b* includes the second cover 450*b*, the second holding plate 470*a* of the first shell 400*a* is curved so as to be wound around the cover body 452*b* and the exposed shield conductor of the second cable 300*b* as best illustrated in FIG. 2H.

Each third terminal 200*c* is constituted by a metal plate and held by the body 100*b*. As each third terminal 200*c* may have a similar configuration to that of a first terminal 200*a*, as best illustrated in FIG. 2D, it will not be described. The third terminal 200*c* includes a contact portion 210*c*, an intermediate portion 220*c*, and a tail 230*c*.

Figure 6A:
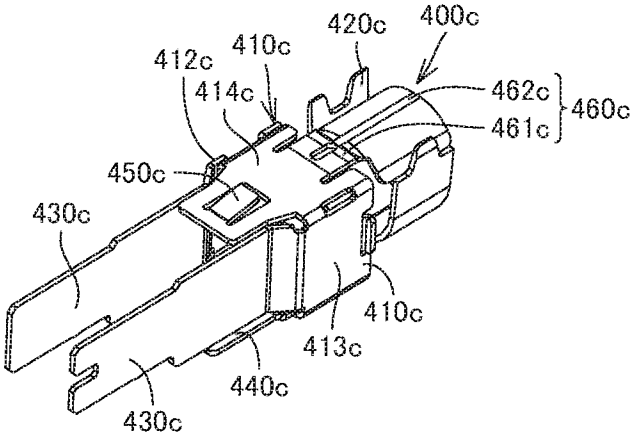
FIG. 6A is a front, top, right side exploded perspective view of the second unit.
Figure 6A:
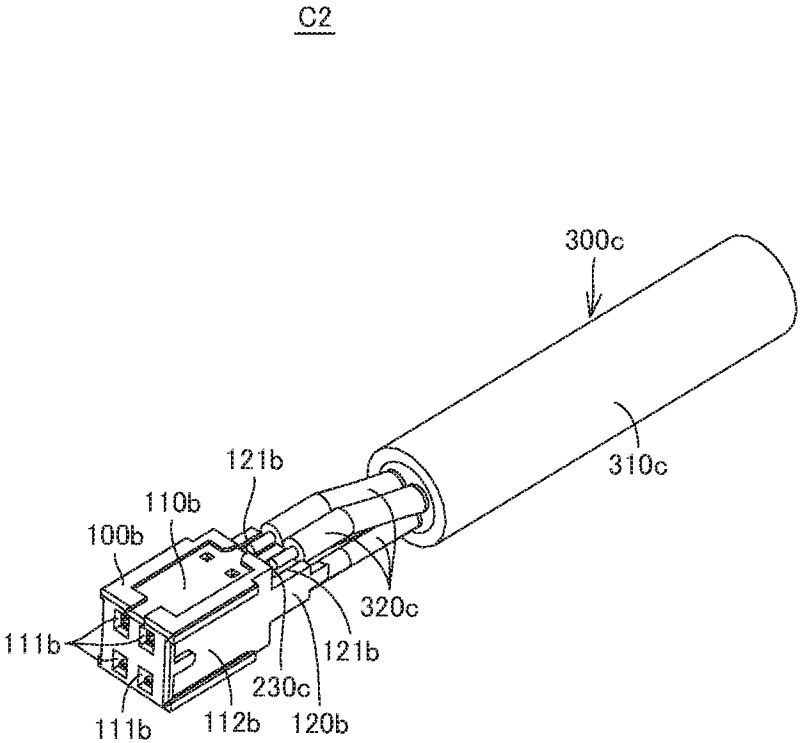
Figure 6B:
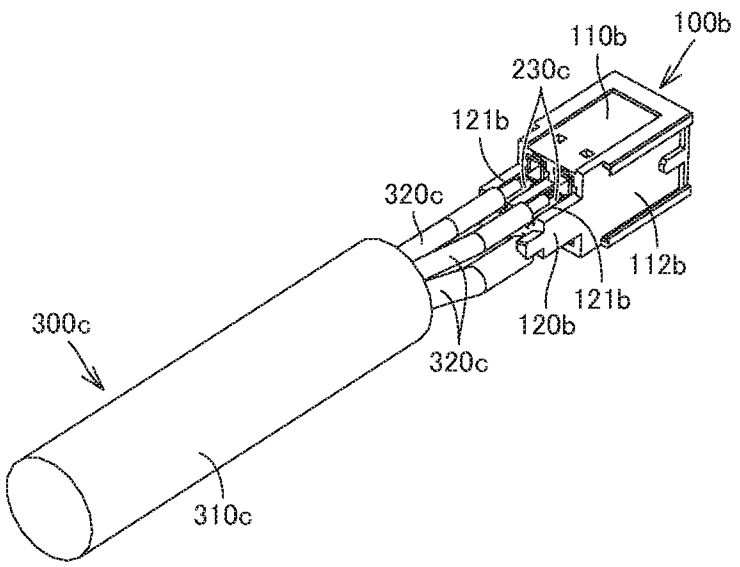
FIG. 6B is a rear, bottom, right side exploded perspective view of the second unit.
Figure 6B:
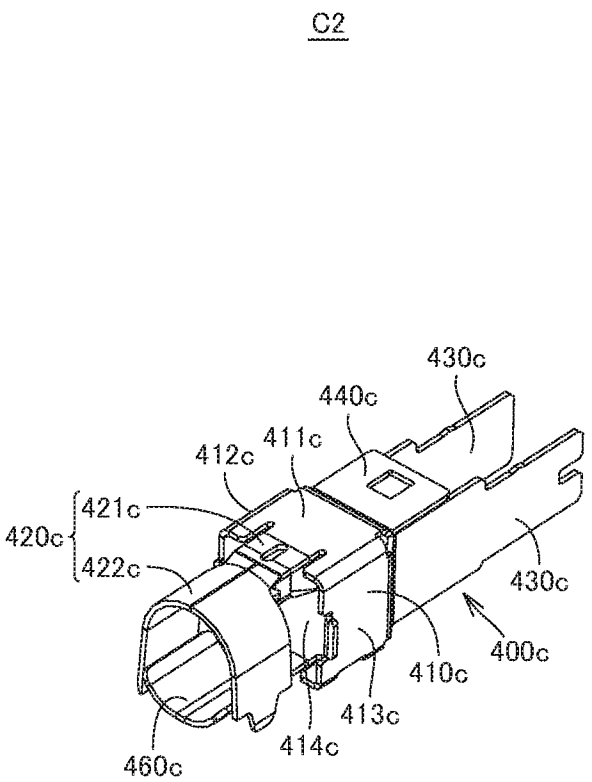

The body 100*b* is formed of insulation resin. As best illustrated in FIGS. 6A and 6B, the body 100*b* includes a main body 110*b*. The main body 110*b* is a rectangular block. The main body 110*a* has an outer shape conforming to the shape of the housing portion 113*a*2 of the body 100*a*. The main body 110*a* is housed in the housing portion 113*a*2 of the body 100*a*. The body 100*b* is housed, together with the body 100*a*, in the shell body 410*b* of the second shell 400*b*.

The main body 110*b* holds the at least one third terminal 200*c*. The main body 110*b* may have at least one holding hole 111*b*. The main body 110*b* may be provided with a plurality of holding holes 111*b* arranged in two rows in the Z-Z' direction, at spaced intervals along the X-X' direction. As best illustrated in FIG. 2D, each holding hole 111*b* extends through the main body 110*b* in the Y-Y' direction. Each holding hole 111*b* has a shape conforming to the outer shape of the intermediate portion 220*c* of a third terminal 200*c*. Each holding hole 111*b* holds the intermediate portion 220*c* of a third terminal 200*c* and houses the contact portion 210*c* of the third terminal 200*c*. Each holding hole 111*b* communicates with an opening 113*a*3 of the body 100*a*. Also, the at least one third terminal 200*c* may be insert-molded in the main body 110*b*. In this case, the holding hole 111*b* is omitted.

The main body 110*b* further includes an end face on the X-direction side and an end face on X'-direction side. As best illustrated in FIGS. 6A and 6B, the end faces of the X- and X'-direction sides of the main body 110*b* may each be provided with an engaging recess 112*b*.

The body 100*b* may further include a table 120*b*. The table 120*b* extends in the Y' direction from the Y'-direction-side end of the main body 110*b*. The table 120*b* may only be able to support the tail 230*c* of the at least one third terminal 200*c*. The table 120*b* may include at least one holding groove 121*b*. Each holding groove 121*b* is provided in the table 120*b* such as to communicate with a holding hole 111*b*. Each holding groove 121*b* houses and supports a tail 230*c*. As best illustrated in FIG. 2F, a plurality of holding grooves 121*b* may be provided in the Z-direction-side face of the table 120*b*, at spaced intervals along the X-X' direction, and another plurality of holding grooves 121*b* may be provided in the Z'-direction-side face of the first table 120*a*, at spaced intervals along the X-X' direction.

As best illustrated in FIG. 6A and FIG. 6B, the third shell 400*c* is formed by press-forming a single metal plate. The third shell 400*c* includes a shell body 410*c* and a third holding plate 420*c*. The shell body 410*c* is a tube extending in the Y-Y' direction and arranged between the first inner plate 440*a* and the second inner plate 450*a* of the first shell 400*a* (see FIG. 2G). The shell body 410*c* includes a first plate 411*c* on the Z'-direction side, a second plate 412*c* on the X-direction side, a third plate 413*c* on the X'-direction side, and a fourth plate on the Z-direction side. The first plate 411*c* is arranged between the first inner plate 440*a* and the second inner plate 450*a* or between the first base 410*a* and the second base 420*a*. In FIG. 2G, the first plate 411*c* is arranged between the first base 410*a* and the second base 420*a*. The first plate 411*c* includes an X-direction-side end, an X'-direction-side end, and a Y'-direction-side end. The fourth plate 414*c* is arranged in abutment with the center plate 430*a* of the first shell 400*a* from the Z'-direction side or arranged to face the center plate 430*a* of the first shell 400*a* with a space therebetween in the Z-Z' direction. In FIG. 2G, the fourth plate 414*c* is in abutment (in surface contact) with the center plate 430*a*. The fourth plate 414*c* may engage with the center plate 430*a*. The fourth plate 414*c* includes an X-direction-side end and an X'-direction-side end. The second plate 412*c* integrally interjoins the X-direction-side end of the first plate 411*c* and the X-direction-side end of the fourth plate 414*c*. The second plate 412*c* is arranged in abutment with the first inner plate 440*a* of the first shell 400*a* or arranged to face the first inner plate 440*a* of the first shell 400*a* with a space therebetween. In FIG. 2G, the second plate 412*c* is in abutment (in surface contact) with the first inner plate 440*a*. The second plate 412*c* may engage with the first inner plate 440*a*. The third plate 413*c* integrally interjoins the X'-direction-side end of the first plate 411*c* and the X'-direction-side end of the fourth plate 414*c*. The third plate 413*c* is arranged in abutment with the second inner plate 450*a* of the first shell 400*a* or arranged to face the second inner plate 450*a* of the first shell 400*a* with a space therebetween. In FIG. 2G, the third plate 413*c* is in abutment with the second inner plate 450*a*. The third plate 413*c* may engage with the second inner plate 450*a*. The second plate 412*c* may further include a Y-direction-side end, and the third plate 413*c* may include a Y-direction-side end.

The third holding plate 420*c* is provided at the first plate 411*c*. The third holding plate 420*c* is arranged between the first holding plate 460*a* and the second holding plate 470*a* of the first shell 400*a* (see FIG. 2H). The third holding plate 420*c* includes a trunk 421*c* and a holding plate body 422*c*. The trunk 421*c* is a plate extending in the Y' direction from the Y'-direction-side end of the first plate 411*c*. The holding plate body 422*c* is a plate integral and contiguous with the Y'-direction-side end of the trunk 421*c*. In planar development state, the holding plate body 422*c* is larger in X-X' direction dimension than the trunk 421*c*.

The third shell 400*c* may further include a pair of shield plates 430*c* (one and the other shield plates 430*c*). The one shield plate 430*c* is a plate extending in the Y direction from the Y-direction-side end of the second plate 412*c*. The other shield plate 430*c* is a plate extending in the Y direction from the Y-direction-side end of the third plate 413*c*. It is preferable that distal end portions (end portions on the Y-direction side) of the shield plates 430*c* be respectively in abutment with at least the end faces of the X- and X'-direction sides of the main body 110*b* of the body 100*b*. The distal end portions of the shield plates 430*c* are housed, together with the main body 110*b*, in the housing portion 113*a*2 of the body 100*a*. As shown in FIGS. 2E and 2F, the one shield plate 430*c* is arranged between the first terminal(s) 200*a* and the third terminal(s) 200*c*, and the other shield plate 430*c* is arranged between the second terminal(s) 200*b* and the third terminal(s) 200*c*. The distal end portions (end portions on the Y-direction side) of the shield plates 430*c* may be configured to respectively engage with the engaging recesses 112*b* of the main body 110*b* of the body 100*b* and to respectively abut the end faces of the X- and X'-direction sides of the main body 110*b*. In this case, the distal ends of the shield plates 430*c* have outer shapes conforming to the respective shapes of the engaging recesses 112*b* of the main body 110*b* of the body 100*b*.

The second shell 400*b* may further include a seventh engaging portion. The third shell 400*c* may further include an eighth engaging portion. One of the seventh engaging portion and the eighth engaging portion may include an engaging protrusion, and the other may have an engaging hole to engage with the engaging protrusion.

For example, as best illustrated in FIG. 4B, the first plate of the shell body 410*b* of the second shell 400*b* may include a pair of seventh engaging portions 470*b*. The seventh engaging portions 470*b* may each include an engaging protrusion of a plate-like shape, which is formed by cutting and bending a part of the first plate of the shell body 410*b* such that the cut part extends in the Z' direction from the first plate. In this case, the third shell 400*c* includes an eighth engaging portion 440*c*. The eighth engaging portion 440*c* includes an engaging plate and an engaging hole. The engaging plate of the eighth engaging portion 440*c* extends in the Y direction from the Y-direction-side end of the first plate 411*c* of the shell body 410*c*. The engaging hole of the eighth engaging portion 440*c* is provided in the engaging plate. As shown in FIG. 3B, the engaging protrusions of the seventh engaging portions 470*b* are engaged with the engaging hole of the eighth engaging portion 440*c* from the Z-direction side.

Further, the eighth engaging portion may include, in place of the engaging hole, an engaging protrusion on the engaging plate. The seventh engaging portion may include an engaging hole in the first plate of the shell body 410*b*, and the engaging hole may engage with the engaging protrusion of the eighth engaging portion.

The third shell 400*c* may further include a ninth engaging portion. The ninth engaging portion may only engage with the center plate 430*a* of the first shell 400*a*. For example, a ninth engaging portion 450*c* is provided at the fourth plate 414*c* of the shell body 410*c*. The ninth engaging portion 450*c* includes an engaging plate and an engaging protrusion. The engaging plate of the ninth engaging portion 450*c* extends in the Y direction from the Y-direction-side end of the fourth plate 414*c*. The engaging protrusion of the ninth engaging portion 450*c* is a plate formed by cutting and bending a part of the engaging plate such that the cut part extends in the Z direction from the engaging plate. The engaging protrusion of the ninth engaging portion 450*c* engage with the Y-direction-side end of the center plate 430*a* of the first shell 400*a*.

The first shell 400*a* may further include a tenth engaging portion. One of the ninth engaging portion and the tenth engaging portion may include an engaging protrusion, and the other may have an engaging hole to engage with the engaging protrusion.

The third cable 300*c* includes an outer insulator 310*c*, a shield conductor (not shown), and at least one transmission wire 320*c*. The outer insulator 310*c* is a tuboid sheath. The shield conductor, tuboid braided conductive wires or a helically wound metal foil tape, is arranged inside the outer insulator 310*c*. The transmission wire(s) 320*c* is arranged inside the shield conductor. The Y-direction-side end portion of the outer insulator 310*c* is cut off such as to expose the Y-direction-side end portion of the shield conductor. Around the exposed shield conductor is wound the holding plate body 422*c* of the third holding plate 420*c* of the third shell 400*c* for electrically connection therebetween (see FIGS. 2A, 2B, 2D, 2H, 3A, and 3B). The Y-direction-side end portion of the transmission wire 320*c* protrudes in the Y direction from the shield conductor. The protruding portion of each transmission wire 320*c* (hereinafter referred to as the protruding portion) is cut off at its distal end such as to expose the core wire inside the transmission wire 320*c*. The protruding portion of each transmission wire 320*c* passes through the shell body 410*c* of the third shell 400*c*, and the core wire of each transmission wire 320*a* is electrically connected to the tail 230*c* of a third terminal 200*c*. For example, there may be four transmission wires 320*c*, the core wires of which may be connected to the respective tails 230*c* of four third terminals 200*c*. It should be noted that FIGS. 2A, 2B, 2D, 2G, and 2H show only the outline of the section of the third cable 300*c*. FIGS. 6A and 6B show the holding plate body 422*c* before being wound around the shield conductor.

The third shell 400*c* may further include a third cover 460*c*. The third cover 460*c* is provided at the fourth plate 414*c* of the shell body 410*c* of the third shell 400*c*. The third cover 460*c* includes a base 461*c* and a cover body 462*c*. The base 461*c* is a plate extending in the Y' direction from the Y'-direction end of the fourth plate 414*c*. The cover body 462*c* is a plate of an arc shape that is integral and contiguous with the Y'-direction-side end of the base 461*c*. The cover body 462*c* partially covers the exposed shield conductor of the third cable 300*c*. If the third shell 400*c* includes the third cover 460*c*, the third holding plate 420*c* of the third shell 400*c* is curved so as to be wound around the cover body 462*c* and the exposed shield conductor of the third cable 300*c*.

As shown in FIG. 1A through FIG. 2H, the connector C may further include an outer case 500. The outer case 500 is formed of insulation resin. The outer case 500 includes a front portion and a rear portion. The outer case 500 further includes a first housing portion 510 and a second housing portion 520. The first housing portion 510 is a hole in the front portion of the outer case 500 and open in the Y direction. The first housing portion 510 has a shape conforming to the outer shape of the shell body 410*b* of the second shell 400*b*. The first housing portion 510 houses the shell body 410*b*, the shield plate 430*c* of the third shell 400*c*, the body 100*a*, the body 100*b*, the first terminal(s) 200*a*, the second terminal(s) 200*b*, and the third terminal(s) 200*c*. The second housing portion 520 is a hole in the rear portion of the outer case 500, and the hole communicates with the first housing portion 510 and is open in the Y' direction. The second housing portion 520 has a shape conforming to the outer shape of the combination of the block portion 420*b* and the first shell 400*a*. The second housing portion 520 houses the block portion 420*b*, the first shell 400*a*, a part of the third shell 400*c* other than the shield plate 430*c*, a Y-direction-side end portion of the first cable 300*a*, a Y-direction-side end portion of the second cable 300*b*, and a Y-direction-side end portion of the third cable 300*c*.

The connector C may further include a cap 600. The cap 600 is formed of insulation resin. The cap 600 is fitted in the second housing portion 520 such as to block the second housing portion 520 of the outer case 500 from the Y'-direction side. The cap 600 is located on the Y'-direction side relative to the first shell 400*a* and the third shell 400*c*. The cap 600 is provided with three holding grooves 610. The respective holding grooves 610 partially hold the first cable 300*a*, the second cable 300*b*, and the third cable 300*c*.

An assembling procedure of the connector C shown in FIGS. 1A to 6B will be hereinafter described in detail. The first unit C1 and the second unit C2 will be assembled independently.

An assembling procedure of the first unit C1 will be hereinafter described in detail. The body 100*a*, the first terminal(s) 200*a*, and the second terminal(s) 200*b* are prepared. Each first terminal 200*a* is inserted into a holding hole 111*a*1 of the body 100*a* from the Y'-direction side. This results in that the intermediate portion 220*a* and the contact portion 210*a* of each first terminal 200*a* are housed in a holding hole 111*a*1 of the body 100*a*, and the tail 230*a* of each first terminal 200*a* is housed in a holding groove 121*a* of the body 100*a*. Each second terminals 200*b* is inserted into a holding hole 112*a*1 of the body 100*a* from the Y'-direction side. This results in that the intermediate portion 220*b* and the contact portion 210*b* of each second terminal 200*b* are housed in a holding hole 112*a*1 of the body 100*a*, and the tail 230*b* of the second terminal 200*b* is housed in a holding groove 131*a* of the body 100*a*. Thus the first terminal(s) 200*a* and the second terminal(s) 200*b* are held by the body 100*a*.

After that, the first cable 300*a* and the second cable 300*b* are prepared. The end portions on the Y-direction side of the first and second cables 300*a* and 300*b* have been processed as described above. The core wire of each transmission wire 320*a* of the first cable 300*a* is soldered to the tail 230*a* of a first terminal 200*a* on Z'-direction side. The core wire of each transmission wire 320*b* of the second cable 300*b* is soldered to the tail 230*b* of a second terminal 200*b* at the side of the Z' direction respectively.

After that, the second shell 400*b* is prepared. The body 100*b* is fitted into the shell body 410*b* of the second shell 400*b* from the Y'-direction side. This results in that the body 100*b*, the first terminal(s) 200*a*, and the second terminal(s) 200*b* are arranged inside the shell body 410*b*. Also, the first cover 440*b* of the second shell 400*b* is brought into contact with the exposed shield conductor of the first cable 300*a*. The second cover 450*b* of the second shell 400*b* is brought into contact with the exposed shield conductor of the second cable 300*b*.

After that, the first shell 400*a* is prepared. The first shell 400*a* is attached to the second shell 400*b* from the Z'-direction side. This attachment results in the arrangements 1) to 6) as follows. 1) The protruding portion of each transmission wire 320*a* of the first cable 300*a* is arranged such as to pass through the first housing space and the first gap of the first shell 400*a*. The protruding portion of each transmission wire 320*b* of the second cable 300*b* is arranged such as to pass through the second housing space and the second gap of the first shell 400*a*. 2) The first holding plate 460*a* of the first shell 400*a* is arranged to face the exposed shield conductor of the first cable 300*a*. The second holding plate 470*a* of the first shell 400*a* is arranged to face the exposed shield conductor of the second cable 300*b*. 3) The center plate 430*a*, the first outer plate 480*a*, and the second outer plate 490*a* of the first shell 400*a* is brought into abutment with the block portion 420*b* of the second shell 400*b* from the Z'-direction side, and the block portion 420*b* blocks the first housing space and the second housing space of the first shell 400*a* from the Z-direction side. 4) The first engaging portion 441*a* of the first shell 400*a* is engaged with the second engaging portion 424*b* of the block portion 420*b* from the Z'-direction side, and the first engaging portion 451*a* of the first shell 400*a* is engaged with the second engaging portion 425*b* of the block portion 420*b* from the Z'-direction side. 5) The third engaging portions 483*a* and 493*a* of the first shell 400*a* are respectively engaged with the engaging holes of the fourth engaging portion 430*b* of the second shell 400*b*. 6) The engaging protrusions of the sixth engaging portion 460*b* of the second shell 400*b* are respectively engaged with the engaging holes of the fifth engaging portion 414*a* of the first base 410*a* and the fifth engaging portion 424*a* of the second base 420*a* of the first shell 400*a* from the Z-direction side.

After that, the first holding plate 460*a* of the first shell 400*a* is curved and wound around the first cover 440*b* of the second shell 400*b* and the exposed shield conductor of the first cable 300*a*. The first holding plate 460*a* is swaged to be fixed to the first cable 300*a*. The second holding plate 470*a* of the first shell 400*a* is curved and wound around the second cover 450*b* of the second shell 400*b* and the exposed shield conductor of the second cable 300*b*. The second holding plate 470*a* is swaged to be fixed to the second cable 300*b*. In this way, it is possible to swage the first holding plate 460*a* and the second holding plate 470*a* without being interfered by the third holding plate 420*c* of the third shell 400*c*. As described above, with the first shell 400*a* attached to the second shell 400*b*, the first unit C1 is assembled.

An assembling procedure of the second unit C2 will be hereinafter described in detail. The body 100*b* and the third terminal(s) 200*c* are prepared. Each third terminal 200*c* is inserted into a holding hole 111*b* of the body 100*b* from the Y'-direction side. This results in that the intermediate portion 220*c* and the contact portion 210*c* of each third terminal 200*c* are housed in a holding hole 111*b* of the body 100*b*, and the tail 230*c* of each third terminal 200*c* is housed in a holding groove 121*c* of the body 100*b*. In this way, the third terminal(s) 200*c* is held by the body 100*b*.

After that, the third cable 300*c* is prepared. The Y-direction-side end portion of the third cable 300*c* have been processed as described above. The core wire of each transmission wires 320*c* of the third cable 300*c* is soldered to the tail 230*c* of a third terminal 200*c*.

After that, the third shell 400*c* is prepared. The third shell 400*c* is a state in which the shell body 410*c* is in planar development state. The shield plate 430*c* on the X'-direction side of the third shell 400*c* is engaged with the engaging recess 112*b* on the X'-direction side of the body 100*b*. After that, the shell 400*c* of the third shell 400*c* is formed into a tubular shape. This forming results in the following arrangements 7) to 10). 7) The shield plate 430*c* on the X-direction side of the third shell 400*c* is engaged with the engaging recess 112*b* on the X-direction side of the body 100*b*. 8) The transmission wire(s) 320*c* of the third cable 300*c* is arranged to pass through the shell body 410*c*. 9) The third cover 460*c* of the third shell 400*c* is brought into contact with the exposed shield conductor of the third cable 300*c*. 10) The third holding plate 420*c* of the third shell 400*c* is arranged to face the exposed shield conductor of the third cable 300*c*.

After that, the third holding plate 420*c* of the third shell 400*c* is curved and wound around the third cover 460*c* of the third shell 400*c* and the exposed shield conductor of the third cable 300*c*. The third holding plate 420*c* of the third shell 400*c* is swaged to be fixed to the third cable 300*c*. As described above, the second unit C2 is assembled. In this way, it is possible to swage the third holding plate 420*c* without being interfered by the first holding plate 460*a* and the second holding plate 470*a*.

An attaching procedure of the second unit C2 to the first unit C1 will be hereinafter described in detail. The body 100*b* and the third terminal 200*c* of the second unit C2, and the distal ends of the pair of the shield plates 430*c* of the third cable 300*c* of the second unit C2 are fitted into the housing portion 113*a*2 of the body 100*b* of the first unit C1. This fitting results in the following arrangements 11) to 15). 11) The distal end portions of the shield plates 430*c* are respectively arranged between the first terminal(s) 200*a* and the third terminal(s) 200*c* and between the second terminal(s) 200*b* and the third terminal(s) 200*c*. 12) The body 100*b*, the third terminal(s) 200*c* and the distal ends of the pair of the shield plates 430*c* of the third cable 300*c* are arranged inside the shell body 410*b* of the second shell 400*b* of the first unit C1. 13) The third holding plate 420*c* of the third shell 400*c* is arranged between the first holding plate 460*a* and the second holding plate 470*a* of the first shell 400*a*. 14) The engaging protrusions of each seventh engaging portion 470*b* of the second shell 400*b* is engaged with an engaging hole of the eighth engaging portion 440*c* of the third shell 400*c*. 15) The ninth engaging portion 450*c* of the third shell 400*c* is engaged with the Y-direction-side end of the center plate 430*a* of the first shell 400*a*. In this way, the second unit C2 is attached to the first unit C1.

After that, the cap 600 is prepared. The first cable 300*a*, the second cable 300*b*, and the third cable 300*c* are held by the holding grooves 610 of the cap 600 respectively. After that, the outer case 500 is prepared. The outer case 500*a* is made to house the first unit C1 and the second unit C2 as combined (excluding the parts other than the Y-direction-side end portions of the first, second, and third cables 300*a*, 300*b*, and 300*c*). The cap 600 is fitted into the outer case 500. Thus, the connector C is assembled.

The connector C of the aspects described above have at least the following technical features. Firstly, the first shell 400*a* in three-dimensional state has a decreased dimension in the X-X' direction for the following reasons. The first shell 400*a* in three-dimensional state is configured such that: the center plate 430*a* is arranged on the Z-direction side relative to the first base 410*a* and the second base 420*a*; the first inner plate 440*a* extends from the first end 411*a* of the first base 410*a* to the first end 431*a* of the center plate 430*a*; and the second inner plate 450*a* extends from the first end 421*a* of the second base 420*a* to the second end 432*a* of the center plate 430*a*. This configuration decreases the space in the X-X' direction between the first base 410*a* and the second base 420*a*, thereby decreasing the X-X' direction dimension of the first shell 400*a* in three-dimensional state, and accordingly, decreasing the X-X' direction dimension of the connector C.

Secondly, the first shell 400*a* in planar development state has an increased space in the X-X' direction between the first holding plate 460*a* and the second holding plate 470*a*. The first shell 400*a* in planar development state is configured such that the center plate 430*a*, the first inner plate 440*a*, the second inner plate 450*a*, the first base 410*a* and the second base 420*a* are aligned along the X-X' direction. Such alignment results in that the space in the X-X' direction between the first base 410*a* and the second base 420*a* increases by the sum of the X-X' direction dimensions of the center plate 430*a*, the first inner plate 440*a* and the second inner plate 450*a*. This in turn results in increased space in the X-X' direction between the first holding plate 460*a*, which is integral and contiguous with the first base 410*a*, and the second holding plate 470*a*, which is integral and contiguous with the second base 420*a*. Therefore, it is easy to form the first base 410*a* and the second base 420*a* when pressing a single metal plate to form the first shell 400*a*.

Thirdly, the existence of the second unit C2 does not result in increase in X-X' direction dimension of the connector C for the following reason. The body 100*b* of the second unit C2 is housed in the housing portion 113*a*2 of the body 100*a* of the first unit C1, and the shell body 410*c* of the third shell 400*c* of the second unit C2 is arranged between the first inner plate 440*a* and the second inner plate 450*a* of the first shell 400*a* of the first unit C1, and the third holding plate 420*c* of the third shell 400*c* is arranged between the first holding plate 460*a* and the second holding plate 470*a* of the first shell 400*a*. Therefore, attaching the second unit C2 to the first unit C1 does not result in an increased X-X' direction dimension of the connector.

Fourthly, the shield case S of the connector C has an improved strength. This is because the shell body 410*c* of the third shell 400*c* abuts the center plate 430*a*, the first inner plate 440*a*, and the second inner plate 450*a* of the first shell 400*a* from inside and also fits inside the combination of the center plate 430*a*, the first inner plate 440*a* and the second inner plate 450*a* (a fitting structure). Further, the first shell 400*a*, the second shell 400*b* and the third shell 400*c* are engaged with each other as described above. Therefore, a load due to prying of the first cable 300*a*, the second cable 300*b*, and/or the third cable 300*c* in the X-X' direction will spread over the fitting structure.

Fifthly, the connector C has a decreased number of components. The first terminal 200*a* and the second terminal 200*b* are held by a single body 100*a*. The body 100*a* and the body 100*b* holding the third terminal(s) 200*c* are housed in the shell body 410*b* of a single second shell 400*b*. It is therefore possible to decrease the number of the components for the connector C, compared to a connector in which the first terminal(s) 200*a*, the second terminal(s) 200*b*, and the third terminal(s) 200*c* are respectively held by different bodies and the bodies are respectively housed in different shells.

Sixthly, it is possible to prevent misalignment in the X-X' direction between the first shell 400*a* and the second shell 400*b* for the following reason. The first engaging portion 441*a* of the first shell 400*a* is engaged with the second engaging portion 424*b* of the second shell 400*b* and the first engaging portion 451*a* of the first shell 400*a* is engaged with the second engaging portion 425*b* of the second shell 400*b*, while the third engaging portion 483*a* and the third engaging portion 493*a* of the first shell 400*a* are respectively engaged with the engaging holes of the fourth engaging portion 430*b* of the second shell 400*b*.

It should be appreciated that the shield case and the connector described above are not limited to the embodiments described above but may be modified in any manner within the scope of the claims. The details are as follows.

The shield case of the invention may be modified in any manner as long as the shield case includes at least the first shell of any of the above aspects or a first shell as described below. The first shell of the shield case of the invention may be modified in any manner as long as the first shell includes the first base, the second base, the center plate, the first inner plate, the second plate, the first holding plate, and the second holding plate of any of the above aspects. For example, the first shell may include a plurality of shell parts adjacent to each other in the X-X' direction. In this case, the shell parts includes two shell parts adjacent to each other. The two shell parts share the first base of any of the above aspects. The center plate of one of the shell parts and the center plate of the other shell part are arranged with a space therebetween in the X-X' direction. The first inner plate of the one shell part extends from the X-direction-side end of the shared first base to the X'-direction-side end of the center plate of the one shell part. The first inner plate of the other shell part extends from X'-direction-side end of the shared first base to X-direction-side end of the center plate of the other shell part. Other than these features, each shell part may have the same configuration as the first shell of any of the above aspects; however, the first outer plate is omitted. It should be noted that the first shell of the shield case of the invention may be provided without the first outer plate, the second outer plate, the first engaging portion, the third engaging portion, the fifth engaging portion, and/or the tenth engaging portion.

The shield case of the invention may include at least the first shell and the block portion of any of the above aspects. In this case, the block portion is not part of the second shell, and the shell body of the second shell is omitted. Alternatively, the shield case of the invention may include at least the first shell and the shell body of the second shell of any of the above aspects. In this case, the block portion of the second shell is omitted. The shell body of the second shell of the invention may be arranged on the Y- or Y'-direction side relative to the first shell. The second shell or the block portion that is not part of the second shell of the shield case of the invention is not limited to one formed by press-forming a metal plate. For example, the second shell or the block portion that is not part of the second shell of the shield case of the invention may be constituted by a metal plate formed by casting. It should be noted that the second shell of the shield case of the invention may be provided without the second engaging portion, the fourth engaging portion, the first cover, the second cover, the sixth engaging portion, and/or the seventh engaging portion.

The third shell of the shield case of the invention may be omitted. If the third shell is omitted, it is preferable that the protruding portion(s) of the transmission wire(s) of the third cable passes through between the first inner plate and the second inner plate of the first shell of any of the above aspects. The third shell of the shield case of the invention may include the first plate and the third holding plate of the third shell of any of the above aspects. In this case, the second to the fourth plates of the shell body of the third shell are omitted. The shell body of the third shell of the shield case of the invention may include the first plate, the second plate, and the third plate of the third shell of any of the above aspects. In this case, the fourth plate of the shell body of the third shell is omitted. The third shell of the shield case of the invention is not limited to a metal plate formed by press-forming. For example, the third shell of the shield case of the invention may be constituted by a metal plate formed by casting. It should be noted that the third shell of the shield case of the invention may be provided without the shield plate, the eighth engaging portion, the ninth engaging portion, and/or the third cover. The third cover of the invention may be provided at the block portion of any of the above aspects.

The first cable of the invention may only be electrically connected to the first terminal(s) of any of the above aspects. For example, the first cable may be electrically connected to the first terminal(s) via connection means, such as a substrate, a cable(s), or a pin(s). The second cable of the invention may only be electrically connected to the second terminal(s) of any of the above aspects. For example, the second cable may be electrically connected to the second terminal(s) via connection means, such as a substrate, a cable(s), or a pin(s). The third cable of the invention may only be electrically connected to the third terminal(s) of any of the above aspects. For example, the third cable may be electrically connected to the third terminal(s) via a connection means, such as a substrate, a cable(s), or a pin(s).

The connector of the invention may be modified in any manner as long as the connector includes the first terminal(s), the second terminal(s), the shield case, the first cable, and the second cable of any of the above aspects. The connector of the invention may further include the first body to hold the first terminal(s) of any of the above aspects and the second body to hold the second terminal (s) of any of the above aspects. In this case, the second unit may be omitted. Alternatively, the connector of the invention may further include the first body to hold the first terminal(s) of any of the above aspects, the second body to hold the second terminal(s) of any of the above aspects, and the third body to hold the third terminal(s) of any of the above aspects. Alternatively, the connector of the invention may further include the first body to hold the first terminal(s) and the second terminal(s) of any of the above aspects, and the third body to hold the third terminal(s) of any of the above aspects. Alternatively, the connector of the invention may further include the first body to hold the first terminal(s), the second terminal(s), and the third terminal(s) of any of the above aspects.

The first body of any of the above aspects may be arranged on the first base of the first shell of any of the above aspects, or may be housed inside the second shell of any of the above aspects. In the former case, it is preferable to omit the shell body of the second shell.

The second body of any of the above aspects may be arranged on the second base of the first shell of any of the above aspects, or may be housed inside the second shell of any of the above aspects. In the former case, it is preferable to omit the shell body of the second shell.

The third body of any of the above aspects may be arranged between the first inner plate and the second inner plate of the first shell of any of the above aspects, or may be arranged on the first plate of the third shell of any of the above aspects, or may be housed inside the second shell of any of the above aspects. In the former two cases, it is preferable to omit the shell body of the second shell.

It is possible to omit the outer case and/or the cap of the connector of the invention.

It should be noted that the materials, the shapes, the dimensions, the numbers, the positions, etc. of the components of the shield case and the connector in the above-described embodiments and their variants are presented by way of example only and can be modified in any manner so far as the same functions can be fulfilled. The aspects and variants of the above-described embodiments can be combined in any possible manner. The first direction (including the X-X' direction) of the invention may be defined in any manner as long as the first direction corresponds to the alignment direction of the first base and the second base of the first shell of the invention. The second direction (including the Y-Y' direction) of the invention may be defined in any manner as long as the second direction crosses the first direction. The third direction (including the Z-Z' direction) of the invention may be defined in any manner as long as the third direction crosses the first and second directions and is located on a different plane from the plane where the first and second directions are located.

REFERENCE SIGNS LIST

C: connector
C1: first unit
100*a*: body (first body)
110*a*: main body
111*a*: first holding portion
111*a*1: holding hole
112*a*: second holding portion
112*a*1: holding hole
113*a*: joint portion
113*a*1: front panel
113*a*2: housing portion
113*a*3: opening
120*a*: first table
121*a*: holding groove
130*a*: second table

131*a*: holding groove
200*a*: first terminal
210*a*: contact portion
211*a*: arm
220*a*: intermediate portion
221*a*: first plate
222*a*: second plate
223*a*: joint plate
230*a*: tail
200*b*: second terminal
210*b*: contact portion
220*b*: intermediate portion
230*b*: tail
300*a*: first cable
310*a*: outer insulator
320*a*: transmission wire
300*b*: second cable
310*b*: outer insulator
320*b*: transmission wire
400*a*: first shell
410*a*: first base
411*a*: first end
412*a*: second end
413*a*: third end
414*a*: fifth engaging portion
420*a*: second base
421*a*: first end
422*a*: second end
423*a*: third end
424*a*: fifth engaging portion
430*a*: center plate
431*a*: first end
432*a*: second end
440*a*: first inner plate
441*a*: first engaging portion
450*a*: second inner plate
451*a*: first engaging portion
460*a*: first holding plate
461*a*: trunk
462*a*: holding plate body
470*a*: second holding plate
471*a*: trunk
472*a*: holding plate body
480*a*: first outer plate
481*a*: outer plate body
482*a*: extension plate
483*a*: third engaging portion
490*a*: second outer plate
491*a*: outer plate body
492*a*: extension plate
493*a*: third engaging portion
400*b*: second shell
410*b*: shell body
420*b*: block portion
421*b*: center portion
422*b*: first facing portion
423*b*: second facing portion
424*b*: second engaging portion
425*b*: second engaging portion
430*b*: fourth engaging portion
440*b*: first cover
441*b*: base
442*b*: cover body
450*b*: second cover
451*b*: base
452*b*: cover body
460*b*: sixth engaging portion
470*b*: seventh engaging portion
C2: second unit
100*b*: body (third body)
110*b*: main body
111*b*: holding hole
112*b*: engaging recess
120*b*: table
121*b*: holding groove
200*c*: third terminal
210*c*: contact portion
220*c*: intermediate portion
230*c*: tail
300*c*: third cable
310*c*: outer insulator
320*c*: transmission wire
400*c*: third shell
410*c*: shell body
411*c*: first plate
412*c*: second plate
413*c*: third plate
414*c*: fourth plate
420*c*: holding plate
421*c*: trunk
422*c*: holding plate body
430*c*: shield plate
440*c*: eighth engaging portion
450*c*: ninth engaging portion
460*c*: third cover
461*c*: base
462*c*: cover body
500: outer case
510: first housing portion
520: second housing portion
600: cap
610: holding groove
S: shield case

What is claimed is:

1. A shield case comprising a first shell constituted by a metal plate, the first shell comprising:

a first base of a plate-like shape, a second base of a plate-like shape, a center plate, a first inner plate, a second inner plate, a first holding plate, and a second holding plate, wherein the first base and the second base are arranged in spaced side-by-side relation along a first direction, the first base comprises a first end at a side of the second base and a second end at one side of a second direction, the second direction crossing the first direction;

the second base comprises a first end at a side of the first base and a second end at one side of the second direction;

the center plate is arranged on one side of a third direction relative to the first and second bases, and the center plate comprises a first end on the one side of the first direction and a second end on the other side of the first direction, the third direction crossing the first and second directions;

the first inner plate extends to the one side of the third direction, from the first end of the first base to the first end of the center plate;

the second inner plate extends to the one side of the third direction, from the first end of the second base to the second end of the center plate;

the first holding plate is integral and contiguous with the second end of the first base; and the second holding plate is integral and contiguous with the second end of the second base.

2. The shield case according to claim 1, wherein the first shell further comprises:

a first outer plate formed at the first base and located on the one side of the first direction relative to the first inner plate with a space therebetween, and a second outer plate formed at the second base and located on the other side of the first direction relative to the second inner plate with a space therebetween.

3. The shield case according to claim 1, further comprising a block portion having electrical conductivity, the block portion being arranged in abutment with or in spaced relation to the center plate of the first shell, the block portion comprising:

a first facing portion arranged in facing relation to and in spaced relation in the third direction to the first base, and a second facing portion arranged in facing relation to and in spaced relation in the third direction to the second base.

4. The shield case according to claim 3, wherein:

the first shell further comprises a first engaging portion provided at at least one of the first inner plate, the second inner plate, and the center plate, the block portion further comprises a second engaging portion, and one of the first engaging portion and the second engaging portion comprises an engaging protrusion, and the other comprises an engaging hole to engage with the engaging protrusion.

5. The shield case according to claim 2, wherein:

the first shell further comprises a third engaging portion provided at at least one of the first outer plate and the second outer plate, the shield case further comprises a block portion having electrical conductivity, the block portion being arranged in abutment with or in spaced relation to the center plate of the first shell, the block portion comprises:

a first facing portion arranged in facing relation to and in spaced relation in the third direction to the first base, and a second facing portion arranged in facing relation to and in spaced relation in the third direction to the second base, and a fourth engaging portion provided at at least one of the first facing portion and the second facing portion, and one of the third engaging portion and the fourth engaging portion comprises an engaging protrusion, and the other comprises an engaging hole to engage with the engaging protrusion.

6. The shield case according to claim 3, wherein:

the first shell further comprises a fifth engaging portion provided at at least one of the first base and the second base, the shield case further comprises a second shell having electrical conductivity, the second shell comprises the block portion, a shell body, and a sixth engaging portion provided at the shell body, and one of the fifth engaging portion and the sixth engaging portion comprises an engaging protrusion, and the other comprises an engaging hole to engage with the engaging protrusion.

7. The shield case according to claim 1, further comprising a third shell having electrical conductivity, wherein:

the third shell comprises a first plate and a third holding plate, the first plate of the third shell is arranged between the first base and the second base or between the first inner plate and the second inner plate and comprises an end on one side of the second direction, and the third holding plate of the third shell is provided at the end of the first plate of the third shell and arranged between the first holding plate and the second holding plate.

8. The shield case according to claim 7, wherein:

the third shell further comprises a shell body arranged between the first inner plate and the second inner plate, and the shell body of the third shell comprises:

a second plate in abutment with the first inner plate, a third plate in abutment with the second inner plate, and the first plate of the third shell to interjoin the second plate and the third plate.

9. The shield case according to claim 8, wherein:

the shell body of the third shell further comprises a fourth plate, and the fourth plate of the third shell interjoins the second plate and the third plate and is in abutment with the center plate of the first shell.

10. The shield case according to claim 6, wherein:

the second shell further comprises a seventh engaging portion provided at the shell body of the second shell, the shield case further comprises a third shell having electrical conductivity, the third shell comprises:

a shell body arranged between the first inner plate and the second inner plate, a third holding plate, and an eighth engaging portion, the shell body of the third shell comprises a first plate, the first plate is arranged between the first base and the second base or between the first inner plate and the second inner plate and comprises an end on one side of the second direction, the third holding plate of the third shell is provided at the end of the first plate of the third shell and arranged between the first holding plate and the second holding plate, the eighth engaging portion of the third shell is provided at the shell body of the third shell, and one of the seventh engaging portion and the eighth engaging portion comprises an engaging protrusion, and the other comprises an engaging hole to engage with the engaging protrusion.

11. A connector comprising:

a first terminal;

a second terminal;

the shield case according to claim 1;

a first cable electrically connected to the first terminal and held by the first holding plate of the first shell; and a second cable electrically connected to the second terminal and held by the second holding plate of the first shell.

12. The connector according to claim 11, further comprising a first body to hold the first terminal and the second terminal.

13. The connector according to claim 12, wherein the shield case further comprises a second shell having electrical conductivity, and the second shell houses at least the first body.

14. The connector according to claim 12, wherein the first body comprises:

a first holding portion arranged on the first base of the first shell to hold the first terminal, a second holding portion arranged on the second base of the first shell to hold the second terminal, and a joint portion to interjoin the first holding portion and the second holding portion.

15. The connector according to claim 11, further comprising:

first body to hold the first terminal, and a second body to hold the second terminal.

16. The connector according to claim 15, wherein the shield case further comprises a second shell having electrical conductivity, and the second shell houses the first body and the second body.

17. The connector according to claim 15, wherein:

the first body is arranged on the first base of the first shell, and the second body is arranged on the second base of the first shell.

18. A connector comprising:

a first terminal;

a second terminal;

a third terminal;

the shield case according to claim 7;

a first cable electrically connected to the first terminal and held by the first holding plate of the first shell;

a second cable electrically connected to the second terminal and held by the second holding plate of the first shell; and a third cable electrically connected to the third terminal and held by the third holding plate of the third shell.

19. The connector according to claim 18, further comprising:

a first body to hold the first terminal and the second terminal, and a third body to hold the third terminal.

20. The connector according to claim 19, wherein:

the first body comprises:

a first holding portion to hold the first terminal, a second holding portion to hold the second terminal, and a joint portion to interjoin the first holding portion and the second holding portion, the joint portion comprises a housing portion, the third body is housed in the housing portion, and the shield case further comprises a second shell having electrical conductivity, the second shell housing the first body and the third body.

21. The connector according to claim 19, wherein:

the first body comprises:

a first holding portion arranged on the first base of the first shell to hold the first terminal, a second holding portion arranged on the second base of the first shell to hold the second terminal, and joint portion to interjoin the first holding portion and the second holding portion, and the third body is arranged on the first plate of the third shell.

* * * * *